US009117406B2

(12) United States Patent
Nakamura et al.

(10) Patent No.: US 9,117,406 B2
(45) Date of Patent: Aug. 25, 2015

(54) DISPLAY APPARATUS AND CONTROL METHOD FOR DISPLAY APPARATUS

(71) Applicant: JOLED INC., Tokyo (JP)

(72) Inventors: Tetsurou Nakamura, Kyoto (JP); Kenichi Masumoto, Hyogo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 14/286,393

(22) Filed: May 23, 2014

(65) Prior Publication Data

US 2014/0252957 A1 Sep. 11, 2014

Related U.S. Application Data

(60) Division of application No. 12/748,871, filed on Mar. 29, 2010, now abandoned, which is a continuation of application No. PCT/JP2009/002621, filed on Jun. 10, 2009.

(30) Foreign Application Priority Data

Jun. 17, 2008 (JP) ..... 2008-158398

(51) Int. Cl.
*G09G 3/32* (2006.01)

(52) U.S. Cl.
CPC ..... *G09G 3/3225* (2013.01); *G09G 3/3233* (2013.01); *G09G 2310/0256* (2013.01);
(Continued)

(58) Field of Classification Search
USPC ..... 345/77, 78, 79, 82, 83, 204; 315/125, 315/169.3, 291, 308
See application file for complete search history.

(56) References Cited

U.S. PATENT DOCUMENTS 5,844,368 A 12/1998 Okuda et al.
6,376,994 B1 4/2002 Ochi et al.
(Continued)

FOREIGN PATENT DOCUMENTS

CN 1707822 12/2005
JP 11-008064 1/1999
(Continued)

OTHER PUBLICATIONS

Definition of Associated ,Dictionary.com Unabridged, http://dictionary.reference.com/browse/associzted?s=t, Feb. 6, 2013, 1 page.
(Continued)

*Primary Examiner* — Douglas W Owens
*Assistant Examiner* — Thai Pham
(74) *Attorney, Agent, or Firm* — Greenblum & Bernstein, P.L.C.

(57) ABSTRACT

A display apparatus is provided which optimally restores decreased luminance and extends a life of a light emitting element. The display apparatus includes a memory that stores a plurality of trap levels in association with a plurality of use durations of the light emitting element. An obtainer determines one of the plurality of use durations of the light emitting element. A controller reads, from the memory, one of the plurality of trap levels associated with the one of the plurality of use durations, and removes a charge from the light emitting element by application of a reverse bias voltage having a level associated with the one of the plurality of trap levels. The controller changes the level of the reverse bias voltage which is applied to the light emitting element so that as the one of the plurality of use durations increases, the level of the reverse bias voltage increases.

8 Claims, 25 Drawing Sheets

(52) U.S. Cl.
CPC .. *G09G2320/0285* (2013.01); *G09G 2320/041* (2013.01); *G09G 2320/045* (2013.01); *G09G 2320/048* (2013.01); *G09G 2330/025* (2013.01); *G09G 2330/04* (2013.01)

(56) References Cited

U.S. PATENT DOCUMENTS

| | | | | |
|---|---|---|---|---|
| 2003/0210212 | A1 | 11/2003 | Li et al. | |
| 2003/0214467 | A1* | 11/2003 | Koyama et al. | 345/82 |
| 2004/0001037 | A1 | 1/2004 | Tsujimura et al. | |
| 2004/0119669 | A1* | 6/2004 | Ishizuka et al. | 345/83 |
| 2004/0150594 | A1 | 8/2004 | Koyama et al. | |
| 2005/0110423 | A1 | 5/2005 | Yuki et al. | |
| 2005/0162354 | A1 | 7/2005 | Osame et al. | |
| 2005/0276995 | A1 | 12/2005 | Kondo et al. | |
| 2006/0012310 | A1 | 1/2006 | Chen et al. | |
| 2006/0050032 | A1 | 3/2006 | Gunner et al. | |
| 2006/0139254 | A1 | 6/2006 | Hayakawa et al. | |
| 2009/0243994 | A1 | 10/2009 | Hatano et al. | |
| 2012/0007901 | A1* | 1/2012 | Yen et al. | 345/698 |

FOREIGN PATENT DOCUMENTS

| | | |
|---|---|---|
| JP | 2000-214824 | 8/2000 |
| JP | 2005-301084 | 10/2005 |
| JP | 2006-276097 | 10/2006 |

OTHER PUBLICATIONS

China Office action, mail date is Sep. 25, 2012.

* cited by examiner

FIG. 4

71

| Device temperature | Use duration | Trap level |
|---|---|---|
| T1 | t1 | E1 |
| | t2 | E2 |
| | ⋮ | ⋮ |
| ⋮ | ⋮ | ⋮ |

FIG. 6

72

| Trap level | Reverse bias voltage |
| --- | --- |
| E1 | B1 |
| E2 | B2 |
| ⋮ | ⋮ |

FIG. 9

73

| Light emitting device | Use duration |
|---|---|
| (1, 1) | t(1, 1) |
| ⋮ | ⋮ |
| (i, j) | t(i, j) |
| ⋮ | ⋮ |

FIG. 10

74

| Mobility | Temperature |
|---|---|
| $\beta 1$ | T1 |
| $\beta 2$ | T2 |
| ⋮ | ⋮ |

FIG. 13

75

| Trap level | Short circuit duration |
| --- | --- |
| E1 | st1 |
| E2 | st2 |
| ⋮ | ⋮ |

71a

| Degree of decrease in luminance (Use duration) | Trap level |
|---|---|
| R1 (t10) | E1 |
| R2 (t11) | E2 |
| ⋮ | ⋮ |

76

| Device temperature | Use duration | Reverse bias voltage |
|---|---|---|
| T1 | t1 | B1 |
| | t2 | B2 |
| | ⋮ | ⋮ |
| ⋮ | ⋮ | ⋮ |

77

| Device temperature | Use duration | Short circuit duration |
|---|---|---|
| T1 | t1 | st1 |
| | t2 | st2 |
| | ⋮ | ⋮ |
| ⋮ | ⋮ | ⋮ |

76a

| Degree of decrease in luminance (Use duration) | Reverse bias voltage |
|---|---|
| R1 (t10) | B1 |
| R2 (t11) | B2 |
| ⋮ | ⋮ |

77a

| Degree of decrease in luminance (Use duration) | Short circuit duration |
|---|---|
| R1 (t10) | st1 |
| R2 (t11) | st2 |
| ⋮ | ⋮ |

DISPLAY APPARATUS AND CONTROL METHOD FOR DISPLAY APPARATUS

CROSS REFERENCE TO RELATED APPLICATION

This is a continuation application of PCT application No. PCT/JP09/002621 filed on Jun. 10, 2009, designating the United States of America, the disclosure of which, including the specification, drawings, and claims, is incorporate herein by reference in its entirety.

The disclosure of Japanese Patent Application No. 2008-158398 filed on Jun. 17, 2008 including specification, drawings and claims is further incorporated herein by reference in its entirety.

BACKGROUND OF THE INVENTION

1. Field of the Invention

The present invention relates to a display apparatus and a control method for the display apparatus, and particularly to a display apparatus using a light emitting element which is driven by an electrical current, as well as to a control method for the display apparatus.

2. Description of the Related Art

An image display apparatus using an organic light emitting diode (abbreviated as OLED) is called an organic EL display and has been known as an image display apparatus using a light emitting element which is driven by an electrical current and has its luminescence intensity controlled in accordance with an amount of the electrical current. This organic EL display has drawn attention for its thinness, light weight, capability of high-speed response and therefore its application as a high-performance thin display apparatus which provides favorable viewing angles and high image quality with less electricity.

However, the OLED in this organic EL display, which is driven by an electrical current, has decreasing luminance due to a trap level that is generated as the electrical current is applied to the OLED. In order to restore such decreased luminance of the OLED, a method of, for example, applying a reverse bias voltage to the OLED is conventionally used. As the method of applying a reverse bias voltage, there has been proposed a method of setting conditions for application of such reverse bias voltage as to restore the decreased luminance of the OLED, and applying the reverse bias voltage under the set conditions (see Patent Reference 1: Japanese Unexamined Patent Application Publication 2005-301084, for example). According to this method of applying the reverse bias voltage, a certain application condition is set, and under the set application condition, the reverse bias voltage is applied, which allows for restoration of the decreased luminance of the OLED. The conventional method, however, has a problem that decreased luminance of the OLED cannot be restored properly. With this method, it is not possible to extend the life of the OLED.

To be specific, in the conventional method, the application of the reverse bias voltage at a constant level according to a certain application condition may, in some cases, result in application of an extraordinary high reverse bias voltage. Such application of an extraordinary high reverse bias voltage causes a sudden change of potential from high forward potential to high reverse potential, thereby leading to instantaneous flow of a large inrush current through the OLED. This instantaneous flow may cause deterioration or breakdown of the OLED. Moreover, setting the application condition for every application of the reverse bias voltage involves enormous amounts of calculation, resulting in a huge load on a control system.

For this reason, in the conventional method, the reverse bias voltage cannot be applied properly, which causes a problem that decreased luminance of the OLED may not be restored optimally. In such a case, it is not possible to extend the life of the OLED.

SUMMARY OF THE INVENTION

In view of the above problem, the present invention has been made, and an object of the present invention is to provide a display apparatus and a control method for the display apparatus, which enable extending a life of a light emitting element such as an organic light emitting diode (OLED) by properly restoring decreased luminance of the light emitting element.

In order to achieve the above object, a display apparatus according to an aspect of the present invention may include: a light emitting element; a power line that supplies a current to the light emitting element; a capacitor that stores a charge; a driver that flows the current through the power line to the light emitting element, the current corresponding to the charge stored in the capacitor; a memory that stores a plurality of trap levels in association with a plurality of use durations of the light emitting element, each of the plurality of trap levels corresponding to an energy level generated in the light emitting element as the current is supplied to the light emitting element; a first obtainer configured to determine one of the plurality of use durations of the light emitting element; and a controller configured to read, from the memory, one of the plurality of trap levels associated with the one of the plurality of use durations of the light emitting element, and to remove a charge generated in the light emitting element by application of a reverse bias voltage to the light emitting element, the reverse bias voltage being associated with the one of the plurality of trap levels read from the memory, wherein, as the one of the plurality of use durations of the light emitting element increases, a level of the reverse bias voltage increases.

According to the present invention, decreased luminance of the light emitting element can be restored properly so that the life of the light emitting element can be longer.

BRIEF DESCRIPTION OF THE DRAWINGS

These and other objects, advantages and features of the invention will become apparent from the following description thereof taken in conjunction with the accompanying drawings that illustrate a specific embodiment of the invention. In the Drawings:

FIG. 4 is a view showing one example of a trap level table according to Embodiment 1;

FIG. 6 is a view showing one example of a trap-bias table according to Embodiment 1;

FIG. 9 is a view showing one example of a use duration table according to Embodiment 1;

FIG. 10 is a view showing one example of a temperature table according to Embodiment 1;

FIG. 13 is a view showing one example of a trap-shorting table according to Variation 1 of Embodiment 1;

DESCRIPTION OF THE PREFERRED EMBODIMENT(S)

Figure 1:
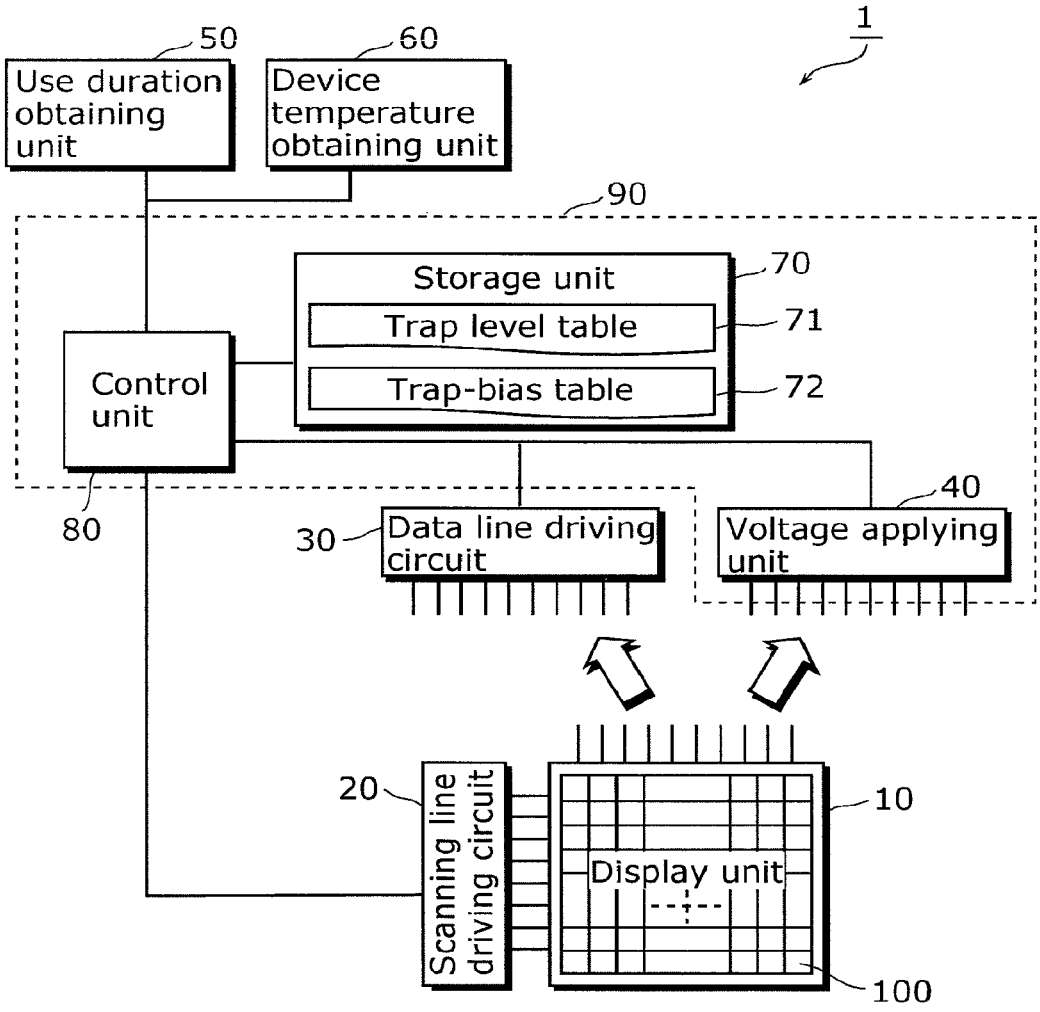
FIG. 1 is a block diagram showing configuration of a display apparatus according to Embodiment 1 of the present invention.

In order to achieve the above object, a display apparatus according to an aspect of the present invention may include: a light emitting element; a power line that supplies a current to the light emitting element; a capacitor that stores a charge; a driver that flows the current through the power line to the light emitting element, the current corresponding to the charge stored in the capacitor; a memory that stores a plurality of trap levels in association with a plurality of use durations of the light emitting element, each of the plurality of trap levels corresponding to an energy level generated in the light emitting element as the current is supplied to the light emitting element; a first obtainer configured to determine one of the plurality of use durations of the light emitting element; and a controller configured to read, from the memory, one of the plurality of trap levels associated with the one of the plurality of use durations of the light emitting element, and to remove a charge generated in the light emitting element by application of a reverse bias voltage to the light emitting element, the reverse bias voltage being associated with the one of the plurality of trap levels read from the memory, wherein, as the one of the plurality of use durations of the light emitting element increases, a level of the reverse bias voltage increases.

According to this aspect, the charges in the trap level are removed based on the trap level by application, to the light emitting element, of the reverse bias voltage having a level associated with the trap level. The trap level herein is an energy level being generated in the light emitting element as the current is supplied to the light emitting element. The level of the reverse bias voltage to be applied to the light emitting element therefore varies in association with the trap level, with the result that the reverse bias voltage will not be extremely high so that the light emitting element can be protected from breakage, and decreased luminance of the light emitting element can be restored properly, which can provide the light emitting element with a longer life.

Further, by focusing on the use duration of the light emitting element to determine the trap level that is an energy level being generated in the light emitting element as the current is supplied to the light emitting element, it is possible to easily and properly determine the trap level that is an energy level being generated in the light emitting element as the current is supplied to the light emitting element. The level of the reverse bias voltage to be applied to the light emitting element therefore varies in association with the use duration of the light emitting element, with the result that the reverse bias voltage will not be extremely high so that the light emitting element can be reliably protected from breakage, and decreased luminance of the light emitting element can be restored properly, which can provide the light emitting element with a longer life.

Preferably, the display apparatus may further include a second obtainer configured to determine one of a plurality of temperatures of the light emitting element, wherein the plurality of trap levels are stored in association with the plurality of the use durations of the light emitting element and in association with the plurality of temperatures of the light emitting element, and the controller is configured to read, from the memory, the one of the plurality of trap levels associated with the one of the plurality of use durations of the light emitting element obtained by the first obtainer and the one of the plurality of temperatures of the light emitting element obtained by the second obtainer.

According to this aspect, the level of the reverse bias voltage to be applied to the light emitting element varies in association with the trap level that is read out with consideration of not only the use duration but also the temperature of the light emitting element, with the result that the reverse bias voltage will not be extremely high so that the light emitting element can be protected from breakage, and decreased luminance of the light emitting element can be restored properly, which can provide the light emitting element with a longer life.

Further, a preferred embodiment of the invention is characterized in that each of the plurality of use durations of the light emitting element indicates a time period from a last application of the reverse bias voltage to the light emitting element until a subsequent application of the reverse bias voltage to the light emitting element.

According to this aspect, the use duration of the light emitting element indicates a length of time counted from a start of application of the reverse bias voltage to the light emitting element. In other words, the use duration of the light emitting element indicates a length of time counted from when decreased luminance of the light emitting element is restored. This causes the reverse bias voltage having a level which is in association with proper use duration of the light emitting element, to be applied to the light emitting element, with the result that the reverse bias voltage will not be extremely high so that the light emitting element can be protected from breakage, and decreased luminance of the light emitting element can be restored properly, which can provide the light emitting element with a longer life.

Further, a display apparatus according to an aspect of the present invention may include: a light emitting element; a power line that supplies a current to the light emitting element; a capacitor that stores a charge; a driver that flows the current through the power line to the light emitting element, the current corresponding to the charge stored in the capacitor; a memory that stores a plurality of trap levels in association with a plurality of use durations of the light emitting element, each of the plurality of trap levels corresponding to an energy level generated in the light emitting element as the current is supplied to the light emitting element; an obtainer configured to determine one of the plurality of use durations of the light emitting element; a shorting transistor that provides an electrical short between an anode and a cathode of the light emitting element; and a controller configured to (i) read, from the memory, one of the plurality of trap levels associated with the one of the plurality of use durations of the light emitting element, and (ii) remove a charge generated in the light emitting element by controlling the shorting transistor to provide the electrical short for a short circuit duration associated with the one of the plurality of trap levels, wherein as the one of the plurality of use durations of the light emitting element increases, the short circuit duration increases.

According to this aspect, the charges in the trap level are removed based on the trap level by causing the shorting transistor to provide an electrical short between the anode and cathode of the light emitting element for short circuit duration associated with the trap level. The trap level herein is an energy level being generated in the light emitting element as the current is supplied to the light emitting element. The short circuit duration for which the shorting transistor provides the electrical short, therefore varies in association with the trap level, with the result that decreased luminance of the light emitting element can be restored properly, which can provide the light emitting element with a longer life.

Further, by focusing on the use duration of the light emitting element to determine the trap level that is an energy level being generated in the light emitting element as the current is supplied to the light emitting element, it is possible to easily and properly determine the trap level that is an energy level being generated in the light emitting element as the current is supplied to the light emitting element. The short circuit duration for which the shorting transistor provides the electrical short, therefore varies in association with the use duration of the light emitting element, with the result that decreased luminance of the light emitting element can be restored properly, which can provide the light emitting element with a longer life.

Further, a preferred embodiment of the invention is characterized in that each of the plurality of use durations of the light emitting element indicates a time period from a last end of the electrical short provided by the shorting transistor until a subsequent start of the electrical short provided by the shorting transistor.

According to this aspect, the use duration of the light emitting element indicates a length of time counted from a start of an electrical short between the anode and cathode of the light emitting element. In other words, the use duration of the light emitting element indicates a length of time counted from when decreased luminance of the light emitting element is restored. The electrical short is thus provided for the short circuit duration which is in association with proper use duration, meaning that it only takes a proper length of time to restore decreased luminance of the light emitting element, and the light emitting element can therefore be provided with a longer life.

Further, a display apparatus according to an aspect of the present invention may include: a light emitting element; a power line that supplies a current to the light emitting element; a capacitor that stores a charge; a driver that flows the current through the power line to the light emitting element, the current corresponding to the charge stored in the capacitor; a first obtainer configured to determine a light emission voltage of the light emitting element; a second obtainer configured to determine a light emission current of the light emitting element; a memory that stores a plurality of trap levels in association with a plurality of degrees of decrease in luminance of the light emitting element, each of the plurality of trap levels corresponding to an energy level generated in the light emitting element as the current is supplied to the light emitting element; and a controller configured to (i) determine one of the plurality of degrees of decrease in luminance of the light emitting element based on the light emission voltage and the light emission current of the light emitting element, the one of the plurality of degrees of decrease in luminance indicating one of a degree of decrease in light emission current which flows through the light emitting element at a constant voltage and a degree of increase in voltage which is required to flow a same current through the light emitting element, (ii) read, from the memory, one of the plurality of trap levels of the light emitting element associated with the one of the plurality of degrees of decrease in luminance, and (iii) remove a charge generated in the light emitting element by application of a reverse bias voltage to the light emitting element, the reverse bias voltage being associated with the one of the plurality of trap levels read from the memory, wherein as the one of the plurality of degrees of decrease in luminance of the light emitting element increases, a level of the reverse bias voltage increases.

According to this aspect, the charges in the trap level are removed based on the trap level by application, to the light emitting element, of the reverse bias voltage having a level associated with the trap level. The trap level herein is an energy level being generated in the light emitting element as the current is supplied to the light emitting element. The level of the reverse bias voltage to be applied to the light emitting element therefore varies in associated with the trap level, with the result that the reverse bias voltage will not be extremely high so that the light emitting element can be protected from breakage, and decreased luminance of the light emitting element can be restored properly, which can provide the light emitting element with a longer life.

Further, by focusing on the degree of decrease in luminance of the light emitting element to determine the trap level that is an energy level being generated in the light emitting element as the current is supplied to the light emitting element, it is possible to properly determine the trap level that is an energy level being generated in the light emitting element as the current is supplied to the light emitting element. The level of the reverse bias voltage to be applied to the light emitting element therefore varies in association with the degree of decrease in luminance of the light emitting element, with the result that the reverse bias voltage will not be extremely high so that the light emitting element can be reliably protected from breakage, and decreased luminance of the light emitting element can be restored properly, which can provide the light emitting element with a longer life.

Further, a preferred embodiment of the invention is characterized in that each of the plurality of degrees of decrease in luminance of the light emitting element is associated with a use duration of the light emitting element.

According to this aspect, the degree of decrease in luminance of the light emitting element is associated with use duration of the light emitting element. This means that as the use duration of the light emitting element is loner, the degree of decrease in luminance of the light emitting element becomes higher. Accordingly, the degree of decrease in luminance of the light emitting element varies in associated with the use duration of the light emitting element, and the level of the reverse bias voltage to be applied to the light emitting element varies in association with the degree of decrease in luminance of the light emitting element, with the result that the reverse bias voltage will not be extremely high so that the light emitting element can be reliably protected from breakage, and decreased luminance of the light emitting element can be restored properly, which can provide the light emitting element with a longer life.

Further, a display apparatus according to an aspect of the present invention may include: a light emitting element; a power line that supplies a current to the light emitting element; a capacitor that stores a charge; a driver that flows the current through the power line to the light emitting element, the current corresponding to the charge stored in the capacitor; a first obtainer configured to determine a light emission voltage of the light emitting element; a second obtainer configured to determine a light emission current of the light emitting element; a memory that stores a plurality of trap levels in association with a plurality of degrees of decrease in luminance of the light emitting element, each of the plurality of trap levels corresponding to an energy level generated in the light emitting element as the current is supplied to the light emitting element; a shorting transistor that provides an electrical short between an anode and a cathode of the light emitting element; and a controller configured to (i) determine one of the plurality of degrees of decrease in luminance of the light emitting element based on the light emission voltage and the light emission current of the light emitting element, the one of the plurality of degrees of decrease in luminance indicating one of a degree of decrease in light emission current which flows through the light emitting element at a constant voltage and a degree of increase in voltage which is required to flow a same current through the light emitting element, (ii) read, from the memory, one of the plurality of trap levels of the light emitting element associated with the one of the plurality of degrees of decrease in luminance, and (iii) remove a charge generated in the light emitting element by controlling the shorting transistor to provide the electrical short for a short circuit duration associated with the one of the plurality of trap levels, wherein as the one of the plurality of degrees of decrease in luminance of the light emitting element increases, the short circuit duration increases.

According to this aspect, the charges in the trap level are removed based on the trap level by causing the shorting transistor to provide an electrical short between the anode and cathode of the light emitting element for a short circuit duration associated with the trap level. The trap level herein is an energy level being generated in the light emitting element as the current is supplied to the light emitting element. The short circuit duration for which the shorting transistor provides the electrical short, therefore varies in association with the trap level, with the result that decreased luminance of the light emitting element can be restored properly, which can provide the light emitting element with a longer life.

Further, by focusing on the degree of decrease in luminance of the light emitting element to determine the trap level that is an energy level being generated in the light emitting element as the current is supplied to the light emitting element, it is possible to properly determine the trap level that is an energy level being generated in the light emitting element as the current is supplied to the light emitting element. The short circuit duration for which the shorting transistor provides the electrical short, therefore varies in association with the degree of decrease in luminance of the light emitting element, with the result that decreased luminance of the light emitting element can be restored properly, which can provide the light emitting element with a longer life.

Further, a preferred embodiment of the invention is characterized in that each of the degrees of decrease in luminance of the light emitting element is associated with a use duration of the light emitting element.

According to this aspect, the degree of decrease in luminance of the light emitting element is associated with use duration of the light emitting element. This means that as the use duration of the light emitting element is loner, the degree of decrease in luminance of the light emitting element becomes higher. Accordingly, the degree of decrease in luminance of the light emitting element varies in associated with the use duration of the light emitting element, and the short circuit duration for which the shorting transistor provides the electrical short varies in association with the degree of decrease in luminance of the light emitting element, with the result that decreased luminance of the light emitting element can be restored properly, which can provide the light emitting element with a longer life.

Further, a display apparatus according to an aspect of the present invention may include: a light emitting element; a power line that supplies a current to the light emitting element; a capacitor that stores a charge; a driver that flows the current through the power line to the light emitting element, the current corresponding to the charge stored in the capacitor; a memory that stores a plurality of reverse bias voltage levels in association with a plurality of use durations of the light emitting element, each of the plurality of reverse bias voltage levels corresponding to a trap level that corresponds to an energy level generated in the light emitting element as the current is supplied to the light emitting element; an obtainer configured to determine one of the plurality of use durations of the light emitting element; and a controller configured to (i) read, from the memory, one of the plurality of reverse bias voltage levels associated with the one of the plurality of use durations of the light emitting element, and (ii) remove a charge generated in the light emitting element by application of a reverse bias voltage corresponding to the one of the plurality of reverse bias voltage levels read from the memory to the light emitting element, wherein as the one of the plurality of use durations of the light emitting element increases, a level of the reverse bias voltage increases.

According to this aspect, the charges in the trap level are removed by application, to the light emitting element, of the reverse bias voltage having a level which is associated with the trap level and varies in association with the use duration of the light emitting element. The trap level herein is an energy level being generated in the light emitting element as the current is supplied to the light emitting element. The level of the reverse bias voltage to be applied to the light emitting element thus varies in association with the use duration of the light emitting element while reflecting the trap level that is an energy level being generated in the light emitting element as the current is supplied to the light emitting element. Accordingly, the reverse bias voltage will not be extremely high so that the light emitting element can be protected from breakage, and decreased luminance of the light emitting element can be restored properly, which can provide the light emitting element with a longer life.

Further, by focusing on the use duration of the light emitting element to determine the trap level that is an energy level being generated in the light emitting element as the current is supplied to the light emitting element, it is possible to easily and properly determine the trap level that is an energy level being generated in the light emitting element as the current is supplied to the light emitting element. The level of the reverse bias voltage to be applied to the light emitting element therefore varies in associated with the use duration of the light emitting element, with the result that the reverse bias voltage will not be extremely high so that the light emitting element can be reliably protected from breakage, and decreased luminance of the light emitting element can be restored properly, which can provide the light emitting element with a longer life.

Further, a display apparatus according to an aspect of the present invention may include: a light emitting element; a power line that supplies a current to the light emitting element; a capacitor that stores a charge; a driver that flows the current through the power line to the light emitting element, the current corresponding to the charge stored in the capacitor; a first obtainer configured to determine a light emission voltage of the light emitting element; a second obtainer configured to determine a light emission current of the light emitting element; a memory that stores a plurality of reverse bias voltage levels in association with a plurality of degrees of decrease in luminance of the light emitting element, each of the plurality of reverse bias voltage levels corresponding to a trap level that corresponds to an energy level generated in the light emitting element as the current is supplied to the light emitting element; and a controller configured to (i) determine one of the plurality of degrees of decrease in luminance of the light emitting element based on the light emission voltage and the light emission current of the light emitting element, the degree of decrease in luminance indicating one of a degree of decrease in light emission current which flows through the light emitting element at a constant voltage and a degree of increase in voltage which is required to flow a same current through the light emitting element, (ii) read, from the memory, one of the plurality of reverse bias voltage levels associated with the one of the plurality of degrees of decrease in luminance, and (iii) remove a charge generated in the light emitting element by application of a reverse bias voltage corresponding to the one of the plurality of reverse bias voltage levels read from the memory to the light emitting element, wherein as the one of the plurality of degrees of decrease in luminance of the light emitting element increases, a level of the reverse bias voltage increases.

According to this aspect, the charges in the trap level are removed by application, to the light emitting element, of the reverse bias voltage having a level which is associated with the trap level and varies in association with the degree of decrease in luminance of the light emitting element. The trap level herein is an energy level being generated in the light emitting element as the current is supplied to the light emitting element. The level of the reverse bias voltage to be applied to the light emitting element thus varies in association with the degree of decrease in luminance of the light emitting element while reflecting the trap level that is an energy level being generated in the light emitting element as the current is supplied to the light emitting element. Accordingly, the reverse bias voltage will not be extremely high so that the light emitting element can be reliably protected from breakage, and decreased luminance of the light emitting element can be restored properly, which can provide the light emitting element with a longer life.

Further, by focusing on the degree of decrease in luminance of the light emitting element to determine the trap level that is an energy level being generated in the light emitting element as the current is supplied to the light emitting element, it is possible to properly determine the trap level that is an energy level being generated in the light emitting element as the current is supplied to the light emitting element. The level of the reverse bias voltage to be applied to the light emitting element therefore varies in association with the degree of decrease in luminance of the light emitting element, with the result that the reverse bias voltage will not be extremely high so that the light emitting element can be reliably protected from breakage, and decreased luminance of the light emitting element can be restored properly, which can provide the light emitting element with a longer life.

It is to be noted that the present invention can be implemented not only as the display apparatus as above, but also as a control method or program for controlling the display apparatus, and as a recording medium in which the program is stored.

Embodiment 1

The following shall describe Embodiment 1 of the present invention in detail with reference to the drawing.

FIG. 1 is a block diagram showing configuration of a display apparatus 1 according to Embodiment 1 of the present invention.

As shown in FIG. 1, the display apparatus 1 includes a display unit 10, a scanning line driving circuit 20, a data line driving circuit 30, a use duration obtaining unit 50, a device temperature obtaining unit 60, and a restoration processing unit 90.

The display unit 10 includes a plurality of pixel units 100 arranged in a matrix. The restoration processing unit 90 includes a voltage applying unit 40, a storage unit 70, and a control unit 80.

Figure 2:
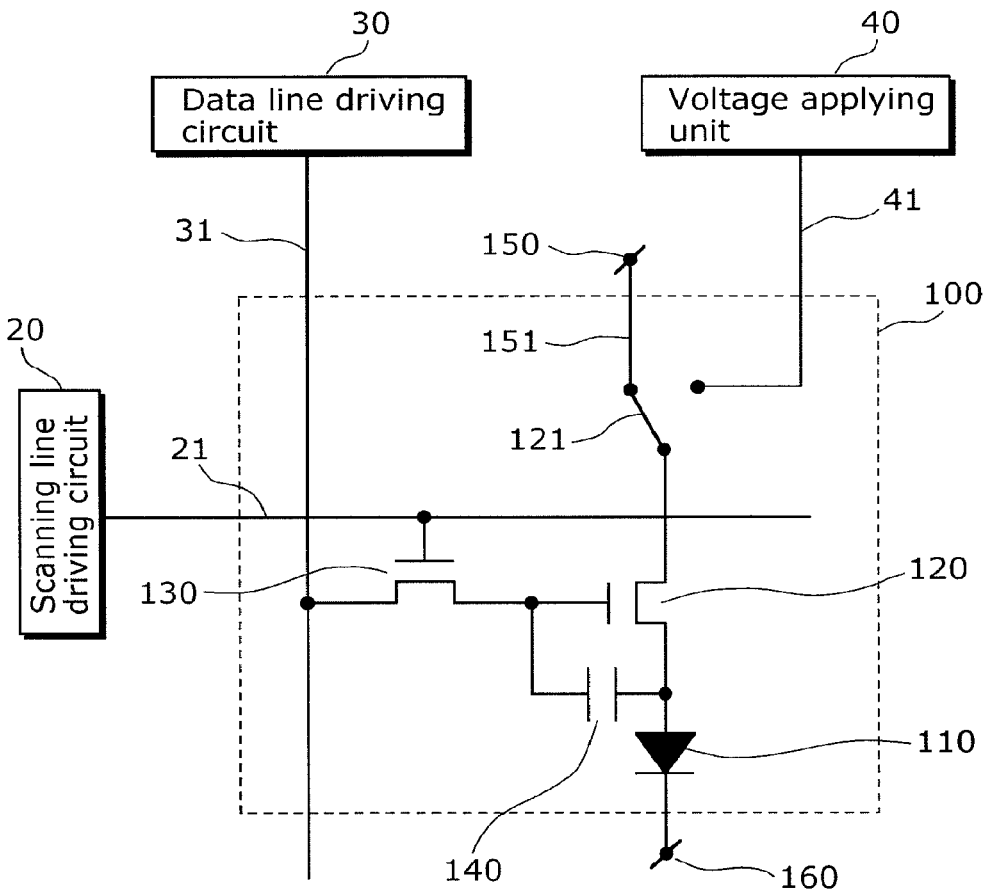
FIG. 2 is a view showing circuit configuration of one of pixel units in a display unit according to Embodiment 1 of the present invention, along with connections of the pixel unit with peripheral circuits.

FIG. 2 is a view showing circuit configuration of one of the pixel units in the display unit 10 according to Embodiment 1, along with connections of the pixel unit with peripheral circuits.

The pixel unit 100 is one of the pixel units in the display unit 10 and has a function of emitting light by a signal voltage supplied thereto through a data line. As shown in FIG. 2, the pixel unit 100 includes a light emitting element 110, a driving transistor 120, a switching transistor 130, a capacitor 140, a scanning line 21, a data line 31, a voltage applying line 41, a switch 121, and a power line 151.

The peripheral circuits of the pixel unit 100 include the scanning line driving circuit 20, the data line driving circuit 30, the voltage applying unit 40, a power source 150, and a power source 160.

Firstly, internal circuit configuration of the pixel unit 100 will be explained with reference to FIG. 2.

The light emitting element 110, also a light emitting device or a light emitter, is an electroluminescent (EL) device which has its anode connected to one of the source and drain of the driving transistor 120 and its cathode connected to the power source 160. The light emitting element 110 has a function of emitting light in response to an electrical current passed through it, which is driven by the driving transistor 120. In other words, the electrical current is supplied to the light emitting element 110 through the power line 151 to cause the light emitting element 110 to emit light. It is to be noted that the light emitting element 110 is, for example, an organic light emitting diode.

The driving transistor 120 has its gate connected to the data line 31 via the switching transistor 130 and the other of its source and drain connected to the switch 121. Via this switch 121, the driving transistor 121 is connected to the power source 150 or the voltage applying unit 40. Further, the driving transistor 120 has a function of converting a signal voltage supplied thereto through the data line 31 into a signal current corresponding to the level of the signal voltage.

The switching transistor 130 has its gate connected to the scanning line 21, one of its source and drain connected to the data line 31, and the other of its source and drain connected to the gate of the driving transistor 120. The switching transistor 130 switches between connection and disconnection between the data line 31 and the gate of the driving transistor 120. To put it another way, the switching transistor 130 has a function of supplying the pixel unit 100 with a value of the signal voltage in the data line 31 during a period of time when the scanning line 21 is "high".

The capacitor 140 is a capacitor for accumulating electric charges. The capacitor 140 is connected between one of the source and drain of the driving transistor 120 and the gate terminal of the driving transistor 120. This means that the driving transistor 120 allows the electrical current according to accumulated charges in the capacitor 140 to flow through the light emitting element 110 via the power line 151.

The power source 150 is a constant voltage source for the driving transistor 120 and is connected to the power line 151. The voltage set on the power source 150 is, for example, 10 V.

The power source 160 is a constant voltage source for the light emitting element 110 and is, for example, grounded. In the present embodiment, the potential of the power source 150 is set to be higher than the potential of the power source 160.

Next, functions of the components shown in FIG. 1 will be explained.

The scanning line driving circuit 20 is connected to the scanning line 21 and has a function of controlling connection and disconnection of the switching transistor 130 in the pixel unit 100.

The data line driving circuit 30 is connected to the data line 31 and has a function of outputting the signal voltage and thereby determining the signal current which flows through the driving transistor 120.

The use duration obtaining unit 50 has a function of obtaining, for each of the pixel units 100, use duration that indicates how long the light emitting element 110 has been used. The use duration indicates an accumulated value of lengths of time that the light emitting element 110 emits light.

For example, when the light emitting element 110 emits light at 60 Hz, one cycle (hereinafter referred to as "one field") is 1 sec/60=approximately 16.6 msec. The use duration therefore indicates a value obtained by accumulating, for subject fields, the length of time that the light emitting element 110 emits light within the period of the one field. Herein, the subject fields indicate all the fields from the last field in which the restoration processing unit 90 restores decreased luminance of the light emitting element 110, to the current field in which the restoration processing unit 90 restores decreased luminance of the light emitting element 110.

Accordingly, the use duration of the light emitting element 110 is reset when the restoration processing unit 90 restores decreased luminance of the light emitting element 110.

The device temperature obtaining unit 60 has a function of obtaining, for each of the pixel units 100, a device temperature which indicates a temperature of the light emitting element 110. How the device temperature obtaining unit 60 obtains the device temperature of the light emitting element 110 will be explained hereinafter in detail.

The restoration processing unit 90 has a function of changing a restoration condition for restoring decreased luminance of the light emitting element 110, depending on the use duration obtained from the use duration obtaining unit 50, and restoring decreased luminance of the light emitting element 110 according to the changed restoration condition. The restoration condition herein indicates a level of a bias voltage which is applied to at least one of the anode and cathode of the light emitting element 110 so as to restore decreased luminance of the light emitting element 110.

To be specific, the restoration processing unit 90 includes a voltage applying unit 40, a storage unit 70, and a control unit 80.

The voltage applying unit 40 has a function of applying a bias voltage to at least one of the anode and cathode of the light emitting element 110 according to a command from the control unit 80. To be specific, the voltage applying unit 40 is connected to the voltage applying line 41 and applies a bias voltage to the anode of the light emitting element 110 via the switch 121 so that a reverse bias voltage is applied to the light emitting element 110, thereby restoring decreased luminance of the light emitting element 110.

The storage unit 70 has a function of holding a trap level for each set of the use duration and device temperature of the light emitting element 110, and a reverse bias voltage associated with the trap level. To be more specific, what the storage unit 70 holds is the trap level, for each set of the use duration and device temperature, of the light emitting element 110, which is calculated in advance based on the relation between the light emission voltage and the light emission current for the light emitting element 110. Moreover, the storage unit 70 holds the reverse bias voltage associated with the trap level, which is calculated in advance based on the relation between the trap level and the reverse bias voltage.

The light emission current herein indicates a current which flows through the light emitting element 110 in order to cause the light emitting element 110 to emit light. The value of the light emission current is the same as that of a signal current which flows through the driving transistor 120. The light emission voltage indicates a voltage that is applied between the anode and cathode of the light emitting element 110 through which the light emission current flows.

To be specific, the storage unit 70 holds a trap level table 71 that associates the use duration, device temperature, and trap level of the light emitting element 110 with one another, and a trap-bias table 72 that associates the trap level with the reverse bias voltage. It is to be noted that the trap level indicates an energy level which is generated in the light emitting element 110 as the current is supplied to the light emitting element 110. This trap level decreases the luminance of the light emitting element 110.

The following shall describe the trap level in detail.

Figure 3A:
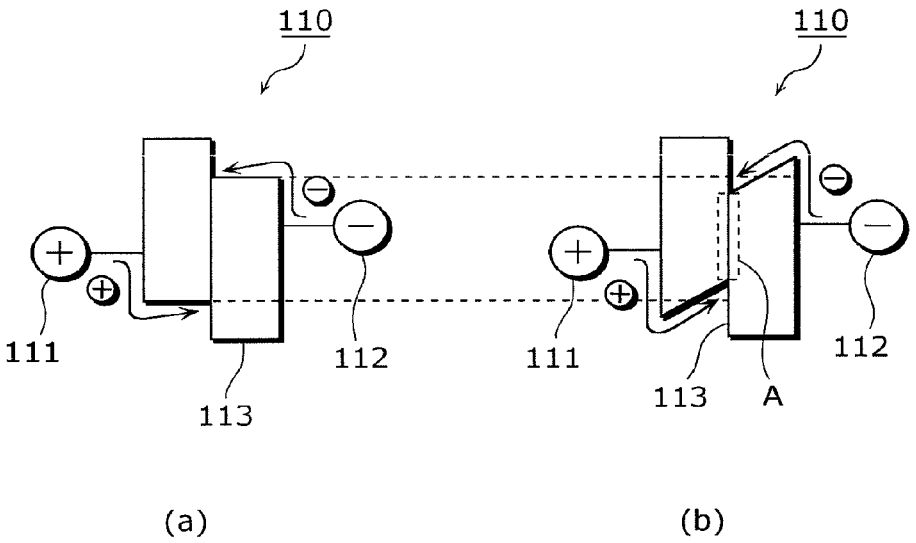
FIG. 3A is a view for explaining a decrease in luminance of a light emitting element due to the trap level.
Figure 3B:
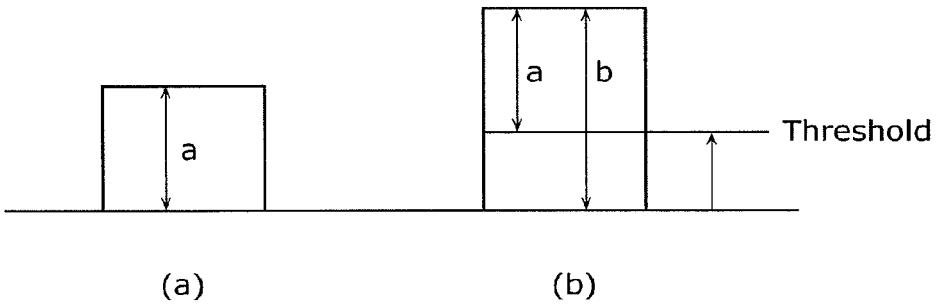
FIG. 3B is a view for explaining a decrease in luminance of a light emitting element due to the trap level.

FIGS. 3A and 3B are views for explaining a decrease in luminance of the light emitting element 110 due to the trap level.

To be specific, FIG. 3A is a pattern diagram showing configuration of the light emitting element 110 to which a voltage is applied, and FIG. 3B is graph showing a voltage level for causing the light emitting element 110 to emit light. FIG. 3A (a) and FIG. 3B (a) show an initial state of the light emitting element 110 to which the voltage has not yet been applied, and FIG. 3A (b) and FIG. 3B (b) show a state of the light emitting element 110 which has the voltage applied thereto and the trap level generated therein.

As shown in these figures, the light emitting element 110 includes a hole injecting electrode 111, an electron injecting electrode 112, and an organic light emitting layer 113 provided between the hole injecting electrode 111 and the electron injecting electrode 112.

Firstly, a voltage is applied to the light emitting element 110 shown in FIG. 3A (a).

Then, electrons accumulate about an electron injecting electrode 112-side of the interface (which is an area denoted by A in FIG. 3A (b)) of the organic light emitting layer 113. Moreover, holes accumulate about a hole injecting electrode 111-side of the interface (which is an area denoted by A in FIG. 3A (b)) of the organic light emitting layer 113.

A trap level is thus generated in the organic light emitting layer 113 as shown in FIG. 3A (b), making a potential barrier higher. This potential barrier causes a decrease in luminance of the light emitting element 110. As a higher the voltage is applied, a deeper trap level is generated, which causes a further decrease in luminance of the light emitting element 110.

To be specific, as shown in FIG. 3B (a), a voltage required to cause the light emitting element 110 in the initial state to emit light is a voltage "a" shown in this figure. The voltage is then applied to the light emitting element 110, and after the light emitting element 110 emits light, the trap level is generated, thereby making a potential barrier higher. This, as shown in FIG. 3B (b), raises a threshold for voltage required to cause the light emitting element 110 to emit light, and in order to obtain the same luminance, it becomes necessary to apply a voltage "b" which is higher than the voltage "a".

In sum, along with the use of the light emitting element 110, there arises the trap level in which charges are trapped, resulting in a voltage loss and thus causing a decrease in luminance of the light emitting element 110 (deterioration of the device).

Further, a reverse bias voltage is applied to the light emitting element 110 to discharge the electrons accumulating about the electron injecting electrode 112-side of the interface of the organic light emitting layer 113 and the holes accumulating about the hole injecting electrode 111-side of the interface of the organic light emitting layer 113, which makes the potential barrier lower. In other words, the application of the reverse bias voltage removes the charges from the trap level, thereby enabling restoration of the deteriorated light emitting element 110.

This restores the deteriorated light emitting element 110 to almost the initial state as shown in FIGS. 3A (a) and 3B (a). The decreased luminance of the light emitting element 110 is thus restored. It is to be noted that as the deterioration level of the light emitting element 110 is higher (the use duration is longer), the trap level becomes deeper, which means that a larger amount of the reverse bias voltage will be required to remove the charges trapped from the trap level.

Next, the trap level table 71 held in the storage unit 70 will be explained.

FIG. 4 is a view showing one example of the trap level table 71 according to Embodiment 1.

As shown in FIG. 4, the trap level table 71 includes the use duration, the device temperature, and the trap level. The use duration indicates a length of time for which the light emitting element 110 has been used, and the device temperature indicates a device temperature of the light emitting element 110. The trap level indicates a trap level for each set of the use duration and device temperature of the light emitting element 110.

The following shall describe that the trap level in the trap level table 71 is calculated from the relation between the light emission voltage and the light emission current for the light emitting element 110.

Figure 5:
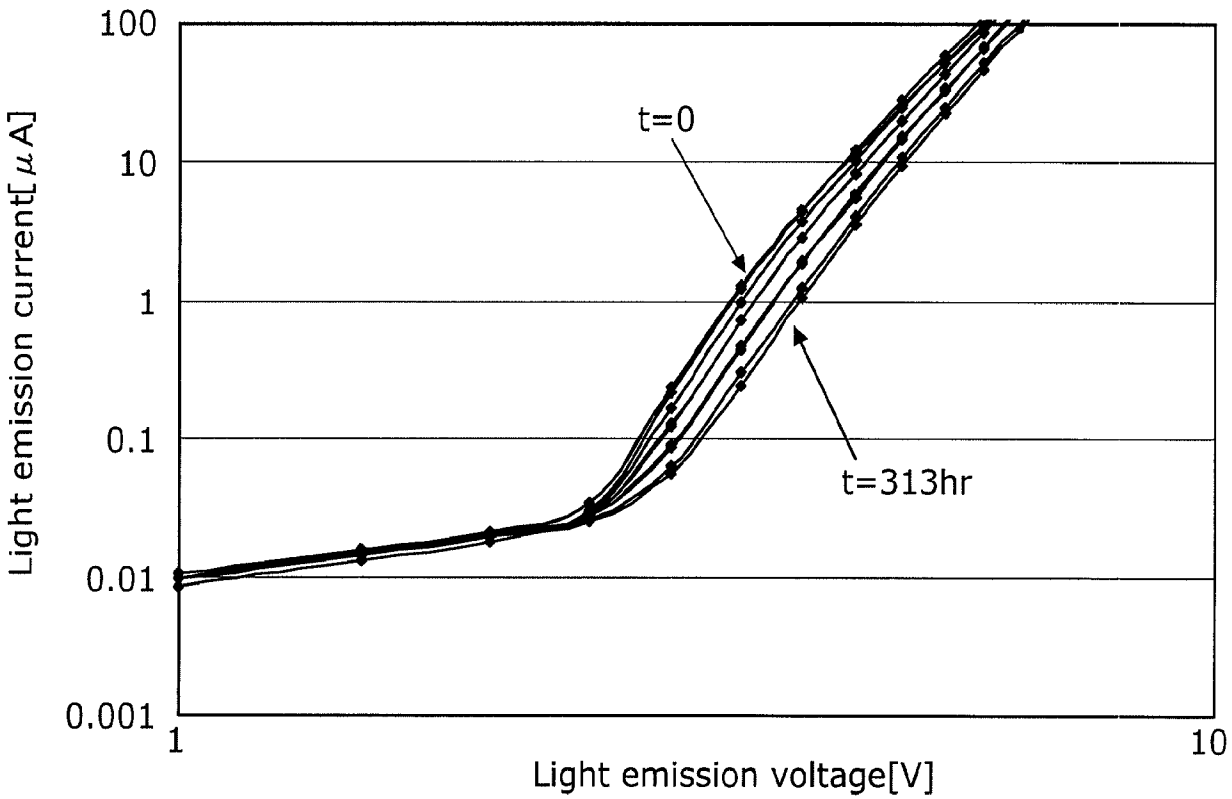
FIG. 5 is a view showing a relation on a use duration-basis between a light emission voltage and a light emission current for the light emitting element.

FIG. 5 is a view showing the relation on a use-duration basis between the light emission voltage and the light emission current for the light emitting element 110.

FIG. 5 shows a graph of measured light emission current, which flows through the light emitting element 110 after use duration "t" has passed, in the case where a constant light emission voltage is applied to the light emitting element 110 to emit light. In this graph, a horizontal axis represents a logarithm of the light emission voltage, and a vertical axis represents a logarithm of the light emission current. This means that FIG. 5 shows a graph showing the relation based on a use duration "t"-basis between the light emission voltage and the light emission current when the use duration "t" accumulates from zero hour to 313 hours. Further, measuring the device temperature of the light emitting element 110 upon measuring the light emission current makes it possible to determine an average device temperature of the light emitting element 110 for each use duration.

In this case, the following expression (1) is satisfied:

$$I \alpha V^{(Et/KT+1)} \quad (1)$$

where "I" represents the light emission current, "V" represents the light emission voltage, "T" represents the device temperature, and "Et" represents the trap level, which are measured after an elapse of the use duration "t", and "K" represents the Boltzmann's constant. The trap level Et is determined by calculation using the relation on the use duration "t"-basis between the light emission voltage V and the light emission current I as shown in FIG. 5, the measured device temperature T, and the expression (1). To be specific, since FIG. 5 is a double logarithmic graph of the light emission voltage V and the light emission current I, the slope of the graph is Et/KT+1 in the expression (1). The slope of the graph shown in FIG. 5 becomes larger with an increase in the use duration t. This means that the trap level Et becomes deeper with an increase in the use duration t.

Thus, referring to the relation between the light emission voltage and the light emission current for the light emitting element 110, the trap level Et is determined for each set of the use duration t and device temperature T of the light emitting element 110.

The trap level table 71 created as above is held in advance in the storage unit 70. It is to be noted that the trap level table 71 may be created for each of the pixel units 100, or alternatively, the trap level table 71 common to all the pixel units 100 may be created.

Next, the trap-bias table 72 held in the storage unit 70 will be explained.

FIG. 6 is a view showing one example of the trap-bias table 72 according to Embodiment 1.

As shown in FIG. 6, the trap-bias table 72 includes the trap level and the reverse bias voltage. The trap level indicates the trap level of the light emitting element 110, and the reverse bias voltage indicates a level of the reverse bias voltage which is applied to the light emitting element 110. The relation between the trap level and the reverse bias voltage will be described below.

Figure 7:
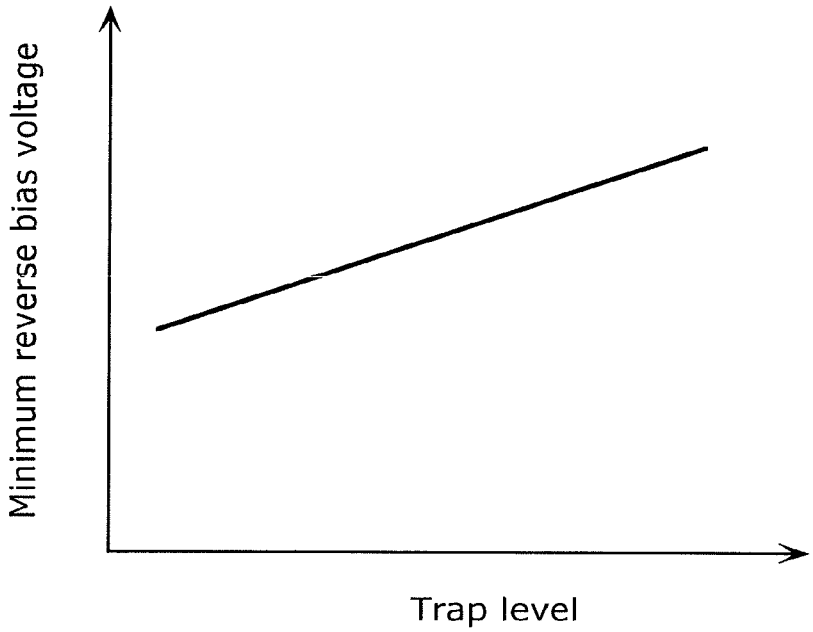
FIG. 7 is a view showing one example of a relation between the trap level and a reverse bias voltage according to Embodiment 1.

FIG. 7 is a view showing one example of the relation between the trap level and the reverse bias voltage according to Embodiment 1.

In FIG. 7, a horizontal axis represents the trap level of the light emitting element 110, and a vertical axis represents a minimum level of the reverse bias voltage which can restore decreased luminance of the light emitting element 110 by application thereto.

To be specific, the minimum reverse bias voltage along the vertical axis is the minimum level out of the reverse bias voltages required to restore decreased luminance of the light emitting element 110. That is, the application of a voltage higher than the minimum reverse bias voltage can restore the decreased luminance of the light emitting element 110 no better than does the application of the minimum reverse bias voltage. Such application of the minimum reverse bias voltage to the light emitting element 110 prevents too much voltage application to the light emitting element 110, resulting in contribution to extending the life of the light emitting element 110.

Moreover, as shown in FIG. 7, a level of the minimum reverse bias voltage is higher with a deeper trap level. This result is obtained from, for example, an experiment in which a reverse bias voltage is applied for different trap levels so that a level of the minimum reverse bias voltage for a certain trap level is calculated. Although the level of the minimum reverse bias voltage increases linearly with an increase in depth of the trap level in FIG. 7, the increase of the minimum reverse bias voltage is not limited to the linear increase.

The minimum reverse bias voltage as associated with the trap level is held as the reverse bias voltage in the trap-bias table 72.

Referring back to FIG. 1, the control unit 80 changes the restoration condition, i.e., the level of the bias voltage so that as the use duration is longer, a difference obtained by subtracting the voltage at the anode of the light emitting element 110 from the voltage at the cathode of the light emitting element 110 becomes larger, and then controls the voltage applying unit 40 to apply the bias voltage having the level thus changed.

To be specific, the control unit 80 (*i*) reads out, by referring to the trap level table 71 held in the storage unit 70, the trap level associated with the use duration of the light emitting element 110, which correspond to the use duration obtained from the use duration obtaining unit 50 and the device temperature obtained from the device temperature obtaining unit 60, and (ii) removes charges from the trap level by application, to the light emitting element 110, of the reverse bias voltage having a level associated with the read-out trap level.

The control unit 80 changes the level of the reverse bias voltage which is to be applied to the light emitting element 110, so that as the use duration of the light emitting element 110 is loner, the level of the reverse bias voltage which is to be applied to the light emitting element 110 becomes higher.

Next, a method of driving the display apparatus 1 for restoring decreased luminance of the light emitting element 110 will be explained.

Figure 8:
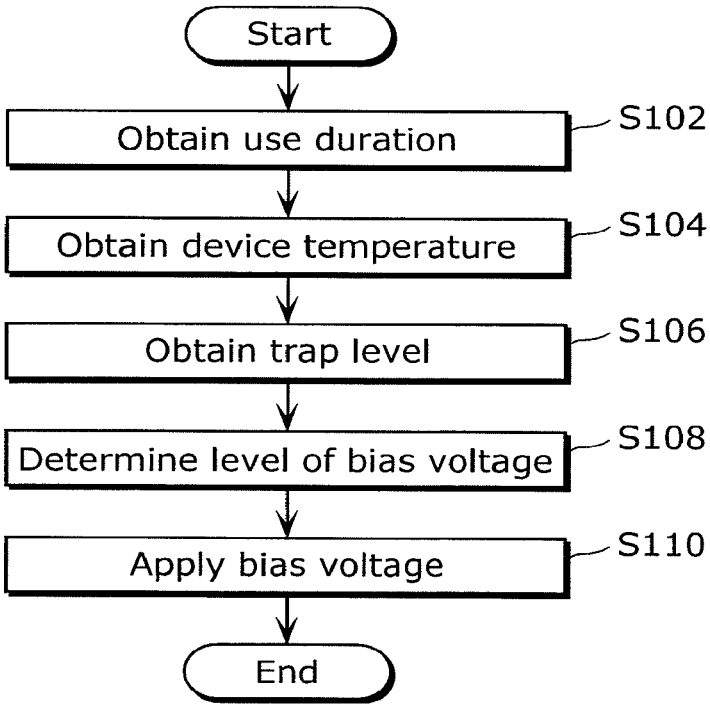
FIG. 8 is a flowchart showing one example of a method of driving the display apparatus, for restoring decreased luminance of the light emitting element according to Embodiment 1.

FIG. 8 is a flowchart showing one example of the method of driving the display apparatus 1, for restoring decreased luminance of the light emitting element 110 according to Embodiment 1.

Firstly, the use duration obtaining unit 50 obtains the use duration of the light emitting element 110 (S102). The use duration of the light emitting element 110 is dependent on behavior between the last application of the reverse bias voltage by the voltage applying unit 40 and subsequent application of the reverse bias voltage by the voltage applying unit 40. That is, an accumulated value of lengths of time that the light emitting element 110 emits light during the above interval between the voltage applications is the use duration of the light emitting element 110.

The use duration is a value calculated by a timer or the like incorporated in the display apparatus 1. To be specific, the use duration obtaining unit 50 obtains the use duration from an accumulating counter which counts only when the light emitting element 110 emits light.

The counter is held in the control unit 80 which writes the use duration for each of the light emitting element 110 into the use duration table 73 as shown in FIG. 9, held in the storage unit 70. FIG. 9 is a view showing on example of the use duration table 73 according to Embodiment 1. In FIG. 9, (i, j) in the section of the light emitting element indicates the light emitting element 110 with coordinates (i, j), and t(i, j) in the section of the use duration indicates the use duration of the light emitting element 110 with coordinates (i, j).

When the voltage applying unit 40 applies the reverse bias voltage to the light emitting element 110, the control unit 80 resets the counter. To be specific, the use duration of the light emitting element 110 to which the reverse bias voltage is applied is rewritten to "0" in the use duration table 73. The use duration obtaining unit 50 refers to the use duration table 73 to obtain the use duration of the light emitting element 110 whose use duration is to be obtained.

Referring back to FIG. 8, the device temperature obtaining unit 60 obtains the device temperature of the light emitting element 110 (S104). To be specific, the control unit 80 calculates the temperature of the driving transistor 120 from properties of the driving transistor 120, and the device temperature obtaining unit 60 obtains the temperature of the driving transistor 120 as the device temperature of the light emitting element 110.

The following shall describe in detail how the device temperature obtaining unit 60 obtains the device temperature of the light emitting element 110.

Firstly, the control unit 80 allows a test current $I_{test}$ to flow between the source and the drain of the driving transistor 120, and then measures a gate voltage $V_g$ which is a voltage at the gate of the driving transistor 120, to calculate mobility β of the driving transistor 120. In this case, the following expression (2) is satisfied:

$$I_{test}=(\beta/2)(V_g-V_s-V_{th})^2 \quad (2)$$

where "$V_s$" represents a source voltage which is applied to the source of the driving transistor 120. In the expression, "$V_{th}$" represents a threshold voltage of the driving transistor 120. This means that the mobility β and the threshold voltage $V_{th}$ can be determined from the gate voltage $V_g$ and the source voltage $V_s$.

To be specific, the expression (2) leads to the following set of simultaneous equations:

$$I_1=(\beta/2)(V_{g1}-V_s-V_{th})^2 \quad (3)$$

$$I_2=(\beta/2)(V_{g2}-V_s-V_{th})^2 \quad (4)$$

where "$I_1$" and "$I_2$" represent two test currents which are different in amount, and "$V_{g1}$" and "$V_{g2}$" represent measurement values of the gate voltage of the driving transistor 120 with such test currents $I_1$ and $I_2$, respectively.

By solving this set of simultaneous equations, the mobility β and the threshold voltage $V_{th}$ can be calculated.

Next, the control unit 80 calculates the temperature T of the driving transistor 120 based on the mobility β of the driving transistor 120 by the following expression (5) using a coefficient k:

$$\beta \alpha \exp(1/kT) \quad (5)$$

It is to be noted that the relation between the mobility β and temperature T of the driving transistor 120, shown by the expression (5), may be held as the temperature 74 as shown in FIG. 10, in the storage unit 70 in advance. FIG. 10 is a view showing one example of the temperature table 74 according to Embodiment 1. In this case, the control unit 80 refers to the temperature table 74 to obtain the temperature T of the driving transistor 120 based on the mobility 13 of the driving transistor 120.

The device temperature obtaining unit 60 obtains as the device temperature of the light emitting element 110 the temperature T of the driving transistor 120 calculated by the control unit 80.

Subsequently, the control unit 80 obtains the trap level based on the use duration and the device temperature which have been obtained, and the trap level table 71 held in advance in the storage unit 70 (S106). To be specific, the control unit 80 refers to the use duration, the device temperature, and the trap level, which are included in the trap level table 71, thereby obtaining the trap level based on the use duration and the device temperature which have been obtained.

The control unit 80 then determines the level of the bias voltage based on the obtained trap level (S108). In the case where any trap level is generated in the light emitting element 110, decreased luminance of the light emitting element 110 can be restored by applying the reverse bias voltage to the light emitting element 110.

To be specific, the control unit 80 determines the level of the bias voltage by referring to the trap-bias table 72 held in the storage unit 70 and obtaining the level of the reverse bias voltage associated with the obtained trap level.

It is to be noted that as the use duration is longer, the trap level becomes deeper, and as the trap level is deeper, the level of the reverse bias voltage becomes higher. In sum, as the use duration is longer, the level of the reverse bias voltage becomes higher.

The control unit 80 controls the voltage applying unit 40 so that the voltage applying unit 40 applies the bias voltage having the determined level to the anode of the light emitting element 110, and the voltage applying unit 40 applies the bias voltage (S110). This means that the voltage applying unit 40 applies the reverse bias voltage of 0 V or more to the light emitting element 110.

To be specific, as shown in FIG. 2, the switch 121 is connected to the power line 151 when the light emitting element 110 emits light. Accordingly, the switch 121 is switched to be connected to the voltage applying line 41 during a short period that the light emitting element 110 does not have to emit light. This causes the voltage applying unit 40 to be connected to the anode of the light emitting element 110. The control unit 80 then gives a command, i.e., the determined level of the bias voltage, to the voltage applying unit 40. In response, the voltage applying unit 40 applies the bias voltage having the determined level to the anode of the light emitting element 110.

To be specific, the control unit 80 controls the voltage applying unit 40 by changing the level of the bias voltage so that as the use duration is longer, a difference obtained by subtracting the voltage at the anode of the light emitting element 110 from the voltage at the cathode of the light emitting element 110 becomes larger, and then causing the voltage applying unit 40 to apply the bias voltage having the level thus changed. The voltage applying unit 40 then applies the bias voltage under the control of the control unit 80.

Such application of the bias voltage associated with the use duration and the device temperature optimizes restoration of decreased luminance of the light emitting element 110, which can provide the light emitting element 110 with a longer life.

In sum, the trap level is used in such a way that the reverse bias voltage having the level associated with the trap level is applied to the light emitting element 110 to remove the charges from the trap level. The level of the reverse bias voltage to be applied to the light emitting element 110 thus varies in association with the trap level. The trap level can be determined easily and properly by focusing on the use duration of the light emitting element 110. The level of the reverse bias voltage to be applied to the light emitting element 110 therefore varies in association with the use duration of the light emitting element 110. Further, since the use duration of the light emitting element 110 indicates a length of time counted from when the decreased luminance of the light emitting element 110 is restored, the reverse bias voltage having the level which is associated with proper use duration is applied to the light emitting element 110.

Accordingly, the reverse bias voltage to be applied to the light emitting element 110 will not be extremely high so that the light emitting element 110 can be protected from breakage, and decreased luminance of the light emitting element 110 can be restored properly, which can provide the light emitting element 110 with a longer life.

Variation 1 of Embodiment 1

The following shall describe Variation 1 of Embodiment 1. In the above Embodiment 1, the reverse bias voltage is applied to the light emitting element 110 to restore decreased luminance of the light emitting element 110. In contrast, the present Variation 1 provides an electrical short between the anode and cathode of the light emitting element 110 to restore decreased luminance of the light emitting element 110.

Figure 11:
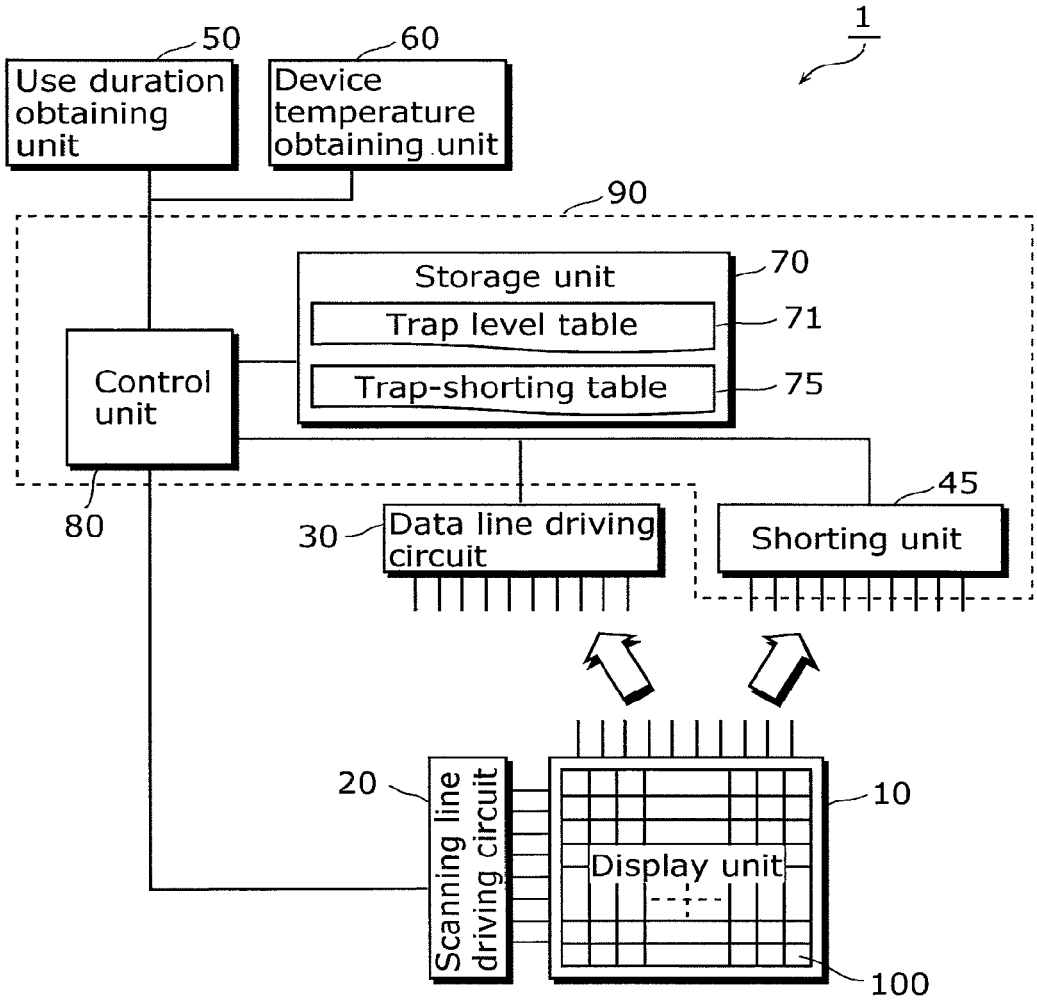
FIG. 11 is a block diagram showing configuration of a display apparatus according to Variation 1 of Embodiment 1.

FIG. 11 is a block diagram showing configuration of a display apparatus 1 according to Variation 1 of Embodiment 1.

As shown in FIG. 11, the display apparatus 1 includes a display unit 10, a scanning line driving circuit 20, a data line driving circuit 30, a use duration obtaining unit 50, a device temperature obtaining unit 60, and a restoration processing unit 90.

The display unit 10 includes a plurality of pixel units 100 arranged in a matrix. The restoration processing unit 90 includes a shorting unit 45, a storage unit 70, and a control unit 80.

Figure 12:
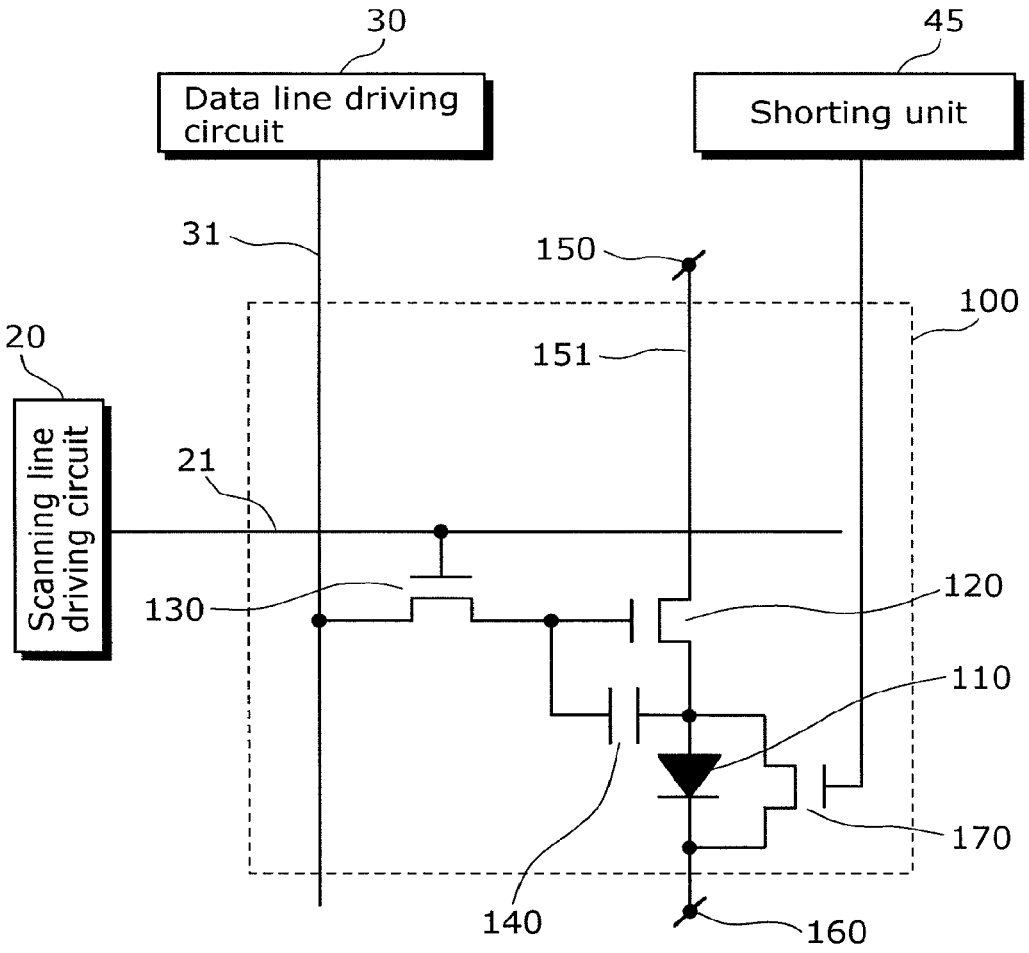
FIG. 12 is a view showing circuit configuration of one of pixel units according to Variation 1 of Embodiment 1, along with connections of the pixel unit with peripheral circuits.

FIG. 12 is a view showing circuit configuration of one of the pixel units 100 according to Variation 1 of Embodiment 1, along with connections of the pixel unit with peripheral circuits.

As shown in FIG. 12, the pixel unit 100 includes a light emitting element 110, a driving transistor 120, a switching transistor 130, a capacitor 140, a scanning line 21, a data line 31, a power line 151, and a shorting transistor 170.

The peripheral circuits of the pixel unit 100 include the scanning line driving circuit 20, the data line driving circuit 30, the shorting unit 45, a power source 150, and a power source 160.

The components having functions already explained with reference to FIGS. 1 and 2 will not be explained below.

The restoration processing unit 90 has a function of changing a restoration condition for restoring decreased luminance of the light emitting element 110, depending on the use duration obtained from the use duration obtaining unit 50, and restoring decreased luminance of the light emitting element 110 according to the changed restoration condition. The restoration condition herein indicates short circuit duration that the circuit between the anode and cathode of the light emitting element 110 is shorted so as to restore decreased luminance of the light emitting element 110.

The shorting unit 45 included in the restoration processing unit 90 has a function of controlling connection and disconnection of the shorting transistor 170 of the pixel unit 100 according to a command from the control unit 80. That is, the shorting unit has a function of providing an electrical short between the anode and cathode of the light emitting element 110.

The shorting transistor 170 has its gate connected to the shorting unit 45, one of its source and drain connected to the anode of the light emitting element 110, and the other of its source and drain connected to the cathode of the light emitting element 110. The shorting transistor 170 is the second switching transistor and switches between connection and disconnection between the anode and the cathode of the light emitting element 110. That is, the shorting transistor 170 provides an electrical short between the anode and cathode of the light emitting element 110 by using a voltage supplied from the shorting unit 45.

The control unit 80 changes the restoration condition, i.e., the short circuit duration so that as the use duration is longer, the short circuit duration becomes longer, and then controls the shorting unit 45 to provide an electrical short between the anode and cathode of the light emitting element for the short circuit duration thus changed.

To be specific, the control unit 80 (*i*) reads out, by referring to the trap level table 71 held in the storage unit 70, the trap level associated with the use duration and temperature of the light emitting element 110, which correspond to the use duration obtained from the use duration obtaining unit 50 and the device temperature obtained from the device temperature obtaining unit 60, and (ii) removes charges from the trap level by causing the shorting transistor 170 to provide an electrical short for short circuit duration associated with the read-out trap level.

The control unit 80 changes the short circuit duration for which the shorting transistor 170 provides the electrical short, so that as the use duration of the light emitting element 110 is longer, the short circuit duration for which the shorting transistor 170 provides the electrical short becomes longer.

The use duration of the light emitting element 110 is dependent on behavior between the last end of the electrical short provided by the shorting transistor 170 and a subsequent start of the electrical short provided by the shorting transistor 170. That is, an accumulated value of lengths of time that the light emitting element 110 emits light during the above interval between the voltage applications is the use duration of the light emitting element 110.

The storage unit 70 holds the trap level table 71 shown in FIG. 4 and a trap-shorting table 75 that associates the trap level and the short circuit duration. The following shall describe the trap-shorting table 75 held in the storage unit 70.

FIG. 13 is a view showing one example of the trap-shorting table 75 according to Variation 1 of Embodiment 1.

As shown in FIG. 13, the trap-shorting table 75 includes the trap level and the short circuit duration. The trap level indicates the trap level of the light emitting element 110, and the short circuit duration indicates a length of time that the circuit between the anode and cathode of the light emitting element 110 is shorted. The relation between the trap level and the short circuit duration will be described below.

Figure 14:
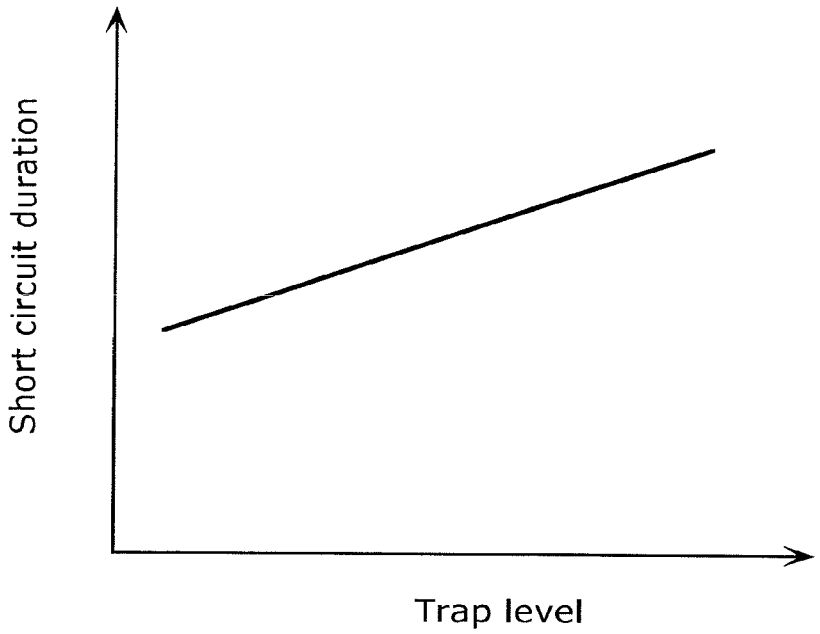
FIG. 14 is a view showing one example of a relation between a trap level and short circuit duration according to Variation 1 of Embodiment 1.

FIG. 14 is a view showing one example of the relation between the trap level and the short circuit duration according to Variation 1 of Embodiment 1.

In FIG. 14, a horizontal axis represents the trap level of the light emitting element 110, and a vertical axis represents the short circuit duration that the circuit between the anode and cathode of the light emitting element 110 is shorted.

To be specific, the short circuit duration along the vertical axis is the minimum length of the short circuit durations required to restore decreased luminance of the light emitting element 110. By providing an electrical short between the anode and cathode of the light emitting element 110 for such short circuit duration, it is possible to restore decreased luminance of the light emitting element 110 in the shortest period of time.

Moreover, as shown in FIG. 14, the short circuit duration is longer with a deeper trap level. This result is obtained from, for example, an experiment in which the circuit between the anode and cathode of the light emitting element 110 is shorted for a certain length of short circuit duration so that the minimum short circuit duration for a certain trap level is calculated. Although the short circuit duration increases linearly with an increase in depth of the trap level in FIG. 14, the increase of the short circuit duration is not limited to the linear increase.

The short circuit duration associated with the trap level is held in the trap-shorting table 75.

Next, a method of driving the display apparatus 1 for restoring decreased luminance of the light emitting element 110 according to Variation 1 will be explained.

Figure 15:
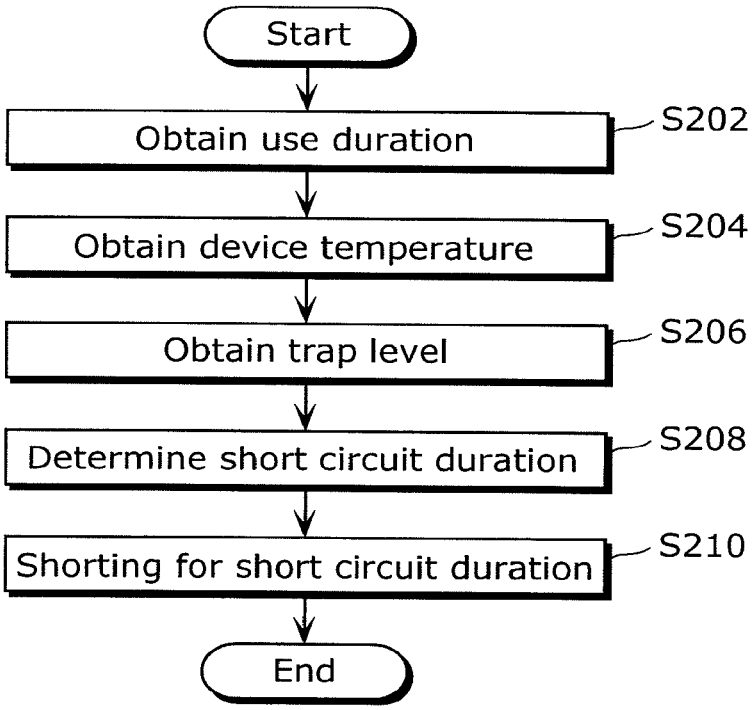
FIG. 15 is a flowchart showing one example of a method of driving the display apparatus, for restoring decreased luminance of a light emitting element according to Variation 1 of Embodiment 1.

FIG. 15 is a flowchart showing one example of the method of driving the display apparatus 1, for restoring decreased luminance of the light emitting element according to Variation 1 of Embodiment 1.

Firstly, the use duration obtaining unit 50 obtains the use duration of the light emitting element 110 (S202), and the device temperature obtaining unit 60 obtains the device temperature of the light emitting element 110 (S204). Subsequently, the control unit 80 obtains the trap level based on the use duration and the device temperature which have been obtained, and the trap level table 71 (S206). Details about how to obtain the use duration, the device temperature, and the trap level are omitted as they are explained with reference to FIG. 8.

Next, the control unit 80 determines, based on the obtained trap level, the short circuit duration for which the circuit between the anode and cathode of the light emitting element 110 is shorted (S208). In the case where any trap level is generated in the light emitting element 110, decreased luminance of the light emitting element 110 can be restored by providing an electrical short between the anode and cathode of the light emitting element 110.

To be specific, the control unit 80 determines the short circuit duration by referring to the trap-shorting table 75 held in the storage unit 70 and obtaining the short circuit duration associated with the obtained trap level.

It is to be noted that as the use duration is longer, the trap level becomes deeper, and as the trap level is deeper, the short circuit duration becomes longer. In sum, as the use duration is longer, the short circuit duration becomes longer.

The control unit 80 controls the shorting unit 45 so that the circuit between the anode and cathode of the light emitting element 110 is shorted for the determined short circuit duration, and the shorting unit 45 provides an electrical short (S210).

To be specific, the control unit 80 gives the shorting unit 45 a command to provide an electrical short for the short circuit duration. The shorting unit 45 then, as shown in FIG. 8, provides the shorting transistor 170 on for the short circuit duration so that the anode and cathode of the light emitting element 110 are connected to each other, and the circuit between the anode and cathode thus remains shorted for the short circuit duration.

The control unit 80 controls the shorting unit 45 by changing the short circuit duration so that as the use duration is longer, the short circuit duration becomes longer, and then causing the shorting unit 45 to provide an electrical short between the anode and cathode of the light emitting element for the changed short circuit duration. The shorting unit 45 then, under the control of the control unit 80, provides an electrical short between the anode and cathode of the light emitting element 110 for the changed short circuit duration.

Such an electrical short between the anode and cathode of the light emitting element 110 for the short circuit duration associated with the use duration and device temperature, optimizes restoration of decreased luminance of the light emitting element 110, which can provide the light emitting element 110 with a longer life.

In sum, the trap level is used in such a way that the shorting transistor 170 provides an electrical short between the anode and cathode of the light emitting element 110 for the short circuit duration associated with the trap level, to remove the charges from the trap level. The short circuit duration for which the shorting transistor 170 provides electrical short, varies in association with the trap level. The trap level can be determined easily and properly by focusing on the use duration of the light emitting element 110. The short circuit duration for which the shorting transistor 170 provides the electrical short, therefore varies in association with the use duration of the light emitting element 110. Further, since the use duration of the light emitting element 110 indicates a length of time counted from when the decreased luminance of the light emitting element 110 is restored, the electrical short is provided for the short circuit duration which is associated with proper use duration.

Accordingly, decreased luminance of the light emitting element 110 can be restored properly, which can provide the light emitting element 110 with a longer life.

Variation 2 of Embodiment 1

The following shall describe Variation 2 of Embodiment 1. In the above Variation 1 of Embodiment 1, as the use duration of the light emitting element 110 is longer, a higher reverse bias voltage is applied, or the short circuit duration is made longer, to restore decreased luminance of the light emitting element 110. In contrast, the present Variation 2 increases the reverse bias voltage which is to be applied to the light emitting element 110 as a degree of decrease in luminance of the light emitting element 110 is higher, thereby restoring decreased luminance of the light emitting element 110.

Figure 16:
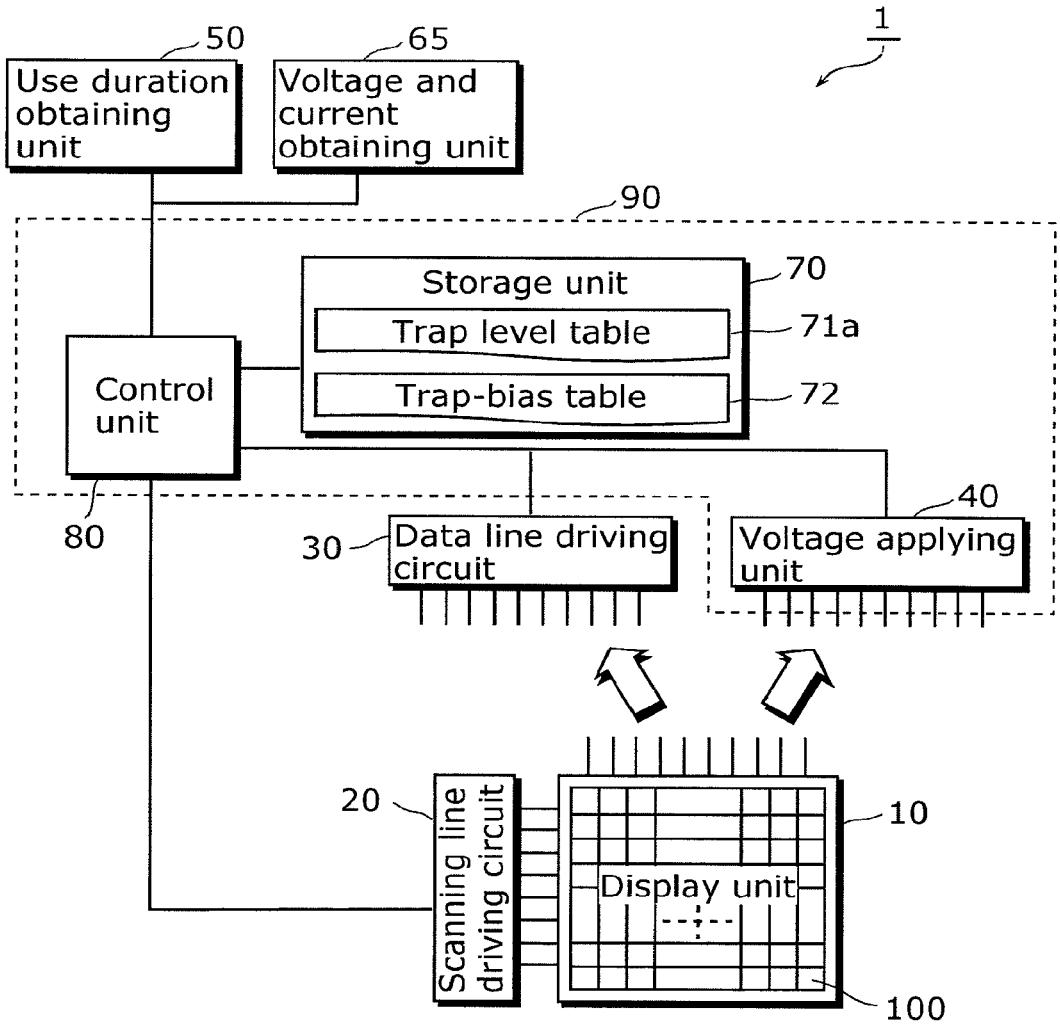
FIG. 16 is a block diagram showing configuration of a display apparatus according to Variation 2 of Embodiment 1.

FIG. 16 is a block diagram showing configuration of a display apparatus 1 according to Variation 2 of Embodiment 1.

As shown in FIG. 16, the display apparatus 1 includes a display unit 10, a scanning line driving circuit 20, a data line driving circuit 30, a use duration obtaining unit 50, a voltage and current obtaining unit 65, and a restoration processing unit 90. The restoration processing unit 90 includes a voltage applying unit 40, a storage unit 70, and a control unit 80. The circuit configuration of the pixel unit 100 and connections of the pixel unit 100 with the peripheral circuits are the same as those shown in FIG. 2. The components having functions already explained with reference to FIGS. 1 and 2 will not be explained below.

The voltage and current obtaining unit 65 has a function of obtaining a light emission voltage and a light emission current for the light emitting element 110.

The storage unit 70 has a function of holding a trap level of the light emitting element 110 for each degree of decrease in luminance, associated with the use duration, of the light emitting element 110, and a reverse bias voltage associated with the trap level. To be more specific, what the storage unit 70 holds are a trap level table 71*a* that associates the degree of decrease in luminance with the trap level, and the trap-bias table 72 shown in FIG. 6.

Figures 17, 18:
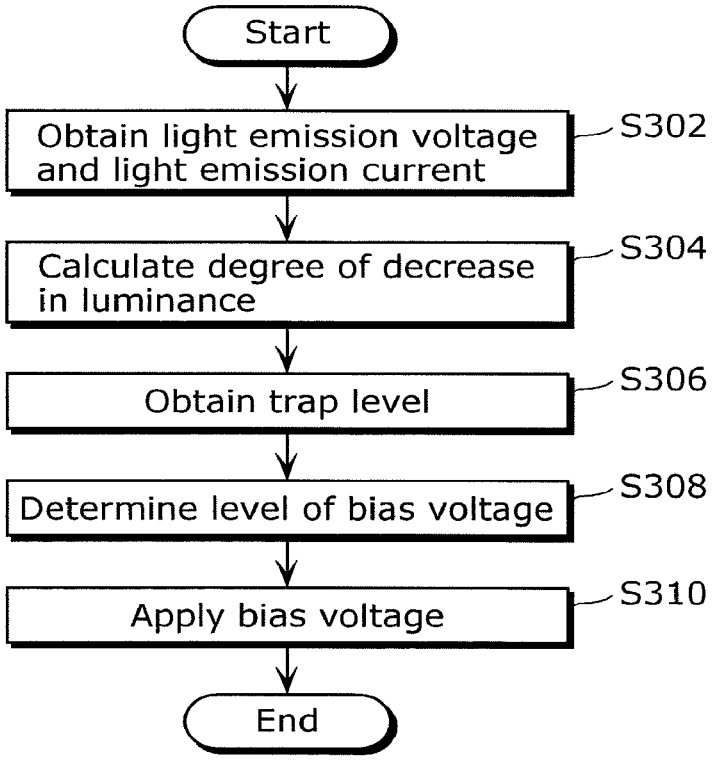
FIG. 17 is a view showing one example of a trap level table according to Variation 2 of Embodiment 1.
FIG. 18 is a flowchart showing one example of a method of driving the display apparatus, for restoring decreased luminance of a light emitting element according to Variation 2 of Embodiment 1.

FIG. 17 is a view showing one example of the trap level table 71*a* according to Variation 2 of Embodiment 1.

As shown in FIG. 17, the trap level table 71*a* includes the degree of decrease in luminance and the trap level. The degree of decrease in luminance indicates a degree of decrease in luminance of the light emitting element 110 in association with use duration of the light emitting element 110. To be more specific, the degree of decrease in luminance represents a degree of decrease in the light emission current which flows through the light emitting element 110, or a degree of increase in the voltage which is supplied to the data line to allow such a current to flow through the light emitting element 110. The degree of decrease in the light emission current indicates a ratio of a decreased light emission current to a not-yet-decreased light emission current. The degree of increase in the voltage indicates a ratio of an increased voltage to a not-yet-increased voltage. In sum, the degree of decrease in luminance of the light emitting element 110 is calculated based on the light emission voltage and light emission current for the light emitting element 110 for the use duration.

The foregoing explanation with reference to FIG. 5 shows that the trap level for each use duration of the light emitting element 110 is calculated based on the relation between the light emission voltage and the light emission current for the light emitting element 110. As in the case of such calculation of the trap level for each use duration of the light emitting element 110, the trap level of the light emitting element 110 for each degree of decrease in luminance of the light emitting element 110 is calculated based on the light emission voltage and light emission current for the light emitting element 110 for each degree of decrease in luminance of the light emitting element 110.

Moreover, the foregoing explanation with reference to FIG. 5 shows that the trap level becomes deeper as the use duration is longer. As the use duration is longer, the degree of decrease in luminance of the light emitting element 110 becomes higher. In sum, as the degree of decrease in luminance of the light emitting element 110 is higher, the trap level becomes deeper.

In this manner, the trap level for each degree of decrease in luminance of the light emitting element 110 is calculated based on the relation between the light emission voltage and light emission current for the light emitting element 110.

It is to be noted that the trap level associated with the degree of decrease in luminance of the light emitting element 110 is not dependent on the device temperature or luminance of the light emitting element 110. This means that even if the device temperature or the luminance changes, the trap level which is associated with the degree of decrease in luminance of the light emitting element 110, does not change. This eliminates the need to take the device temperature and the luminance into account in the calculation of the trap level, which leads to an accurate calculation of the trap level.

The trap level table 71*a* created as above is held in advance in the storage unit 70. It is to be noted that the trap level table 71*a* may be created for each of the pixel units 100, or alternatively, the trap level table 71*a* common to all the pixel units 100 may be created.

Referring back to FIG. 16, the control unit 80 (*i*) calculates a degree of decrease in luminance of the light emitting element 110 based on the light emission voltage and light emission current for the light emitting element 110, (ii) reads out, by referring to the trap level table 71*a* held in the storage unit 70, the trap level of the light emitting element 110 associated with the calculated degree of decrease in luminance, and (iii) removes charges from the trap level by application, to the light emitting element 110, of the reverse bias voltage having a level associated with the read-out trap level.

The control unit 80 changes the level of the reverse bias voltage which is to be applied to the light emitting element 110 so that as the degree of decrease in luminance of the light emitting element 110 is higher, the level of the reverse bias voltage which is to be applied to the light emitting element 110 becomes higher.

Next, a method of driving the display apparatus 1 for restoring the decreased luminance of the light emitting element 110 will be explained.

FIG. 18 is a flowchart showing one example of the method of driving the display apparatus 1, for restoring decreased luminance of the light emitting element 110 according to Variation 2 of Embodiment 1.

Firstly, the voltage and current obtaining unit 65 obtains the light emission voltage and light emission current for the light emitting element 110 (S302). The light emission voltage and the light emission current may be measured or calculated values.

Next, the control unit 80 calculates a degree of decrease in luminance of the light emitting element 110 based on the light emission voltage and light emission current for the light emitting element 110, which have been obtained from the voltage and current obtaining unit 65 (S304).

Subsequently, the control unit 80 obtains the trap level based on the calculated degree of decrease in luminance of the light emitting element 110 and the trap level table 71*a* held in the storage unit 70 (S306). To be specific, the control unit 80 refers to the degree of decrease in luminance and the trap level, which are included in the trap level table 71*a*, thereby obtaining the trap level based on the calculated degree of decrease in luminance.

The control unit 80 then determines the level of the bias voltage by referring to the trap-bias table 72 and obtaining the level of the reverse bias voltage associated with the obtained trap level (S308).

It is to be noted that the trap level becomes deeper as the degree of decrease in luminance of the light emitting element 110 is higher. In addition, it has been found that as the trap level is deeper, the level of the reverse bias voltage becomes higher. In sum, as the degree of decrease in luminance of the light emitting element 110 is higher, the level of the reverse bias voltage becomes higher.

Thus, the control unit 80 determines the level of the bias voltage by calculating the level of the bias voltage associated with the trap level.

The control unit 80 controls the voltage applying unit 40 so that the voltage applying unit 40 applies the bias voltage having the determined level to the anode of the light emitting element 110, and the voltage applying unit 40 applies the bias voltage (S310).

Such application of the bias voltage associated with the degree of decrease in luminance of the light emitting element 110 optimizes restoration of decreased luminance of the light emitting element 110, which can provide the light emitting element 110 with a longer life.

In sum, the trap level is used in such a way that the reverse bias voltage having the level associated with the trap level is applied to the light emitting element 110 to remove the charges from the trap level. The level of the reverse bias voltage to be applied to the light emitting element 110 varies in association with the trap level. The trap level can be determined properly by focusing on the degree of decrease in luminance of the light emitting element 110. The level of the reverse bias voltage to be applied to the light emitting element 110 therefore varies in association with the degree of decrease in luminance of the light emitting element 110.

The degree of decrease in luminance of the light emitting element 110 is associated with use duration of the light emitting element 110. This means that as the use duration of the light emitting element 110 is longer, the degree of decrease in luminance of the light emitting element becomes higher. Accordingly, the degree of decrease in luminance of the light emitting element 110 varies in association with the use duration of the light emitting element 110, and the level of the reverse bias voltage to be applied to the light emitting element 110 varies in association with the degree of decrease in luminance of the light emitting element 110.

Consequently, the reverse bias voltage to be applied to the light emitting element 110 will not be extremely high so that the light emitting element 110 can be reliably protected from breakage, and decreased luminance of the light emitting element 110 can be restored properly, which can provide the light emitting element 110 with a longer life.

Variation 3 of Embodiment 1

The following shall describe Variation 3 of Embodiment 1. In the above Variation 1 of Embodiment 1, as the use duration of the light emitting element 110 is longer, a higher reverse bias voltage is applied, or the short circuit duration is made longer, to restore decreased luminance of the light emitting element 110. In the above Variation 2, as a degree of decrease in luminance of the light emitting element 110 is higher, a higher reverse bias voltage is applied to the light emitting element 110 to restore decreased luminance of the light emitting element 110. In contrast, the present Variation 3 makes the short circuit duration of the light emitting element 110 longer as the degree of decrease in luminance of the light emitting element 110 is higher, thereby restoring decreased luminance of the light emitting element 110.

Figure 19:
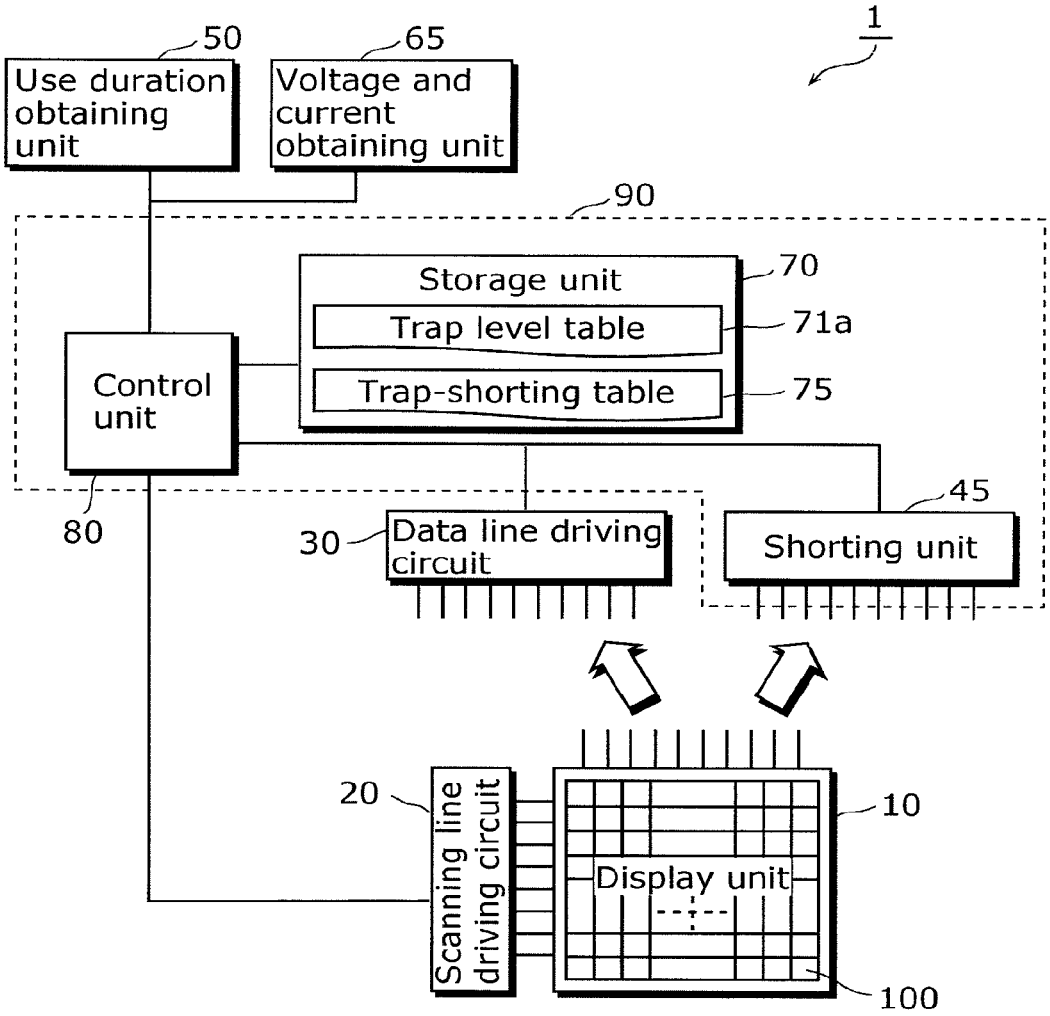
FIG. 19 is a block diagram showing configuration of a display apparatus according to Variation 3 of Embodiment 1.

FIG. 19 is a block diagram showing configuration of a display apparatus 1 according to Variation 3 of Embodiment 1.

As shown in FIG. 19, the display apparatus 1 includes a display unit 10, a scanning line driving circuit 20, a data line driving circuit 30, a use duration obtaining unit 50, a voltage and current obtaining unit 65, and a restoration processing unit 90. The restoration processing unit 90 includes a shorting unit 45, a storage unit 70, and a control unit 80. The circuit configuration of the pixel unit 100 and connections of the pixel unit 100 with the peripheral circuits are the same as those shown in FIG. 12.

It is to be noted that the configuration of the display apparatus 1 according to Variation 3 is formed by replacing the device temperature obtaining unit 60 and the trap level table 71 in the configuration shown in FIG. 11 and FIG. 12 with the voltage and current obtaining unit 65 and the trap level table 71*a* shown in FIG. 16. Accordingly, all components in the configuration of the display apparatus 1 according to Variation 3 have functions already explained with reference to FIGS. 11, 12, and 16, and therefore will not be explained in detail.

The control unit 80 (*i*) calculates a degree of decrease in luminance of the light emitting element 110 based on the light emission voltage and light emission current for the light emitting element 110, (ii) reads out, by referring to the trap level table 71*a* held in the storage unit 70, the trap level of the light emitting element 110 associated with the calculated degree of decrease in luminance, and (iii) removes charges from the trap level by causing the shorting transistor 170 to provide an electrical short for the short circuit duration associated with the read-out trap level.

The control unit 80 changes the short circuit duration for which the shorting transistor 170 provides the electrical short, so that as the degree of decrease in luminance of the light emitting element 110 is higher, the short circuit duration for which the shorting transistor 170 provides the electrical short becomes longer.

Figure 20:
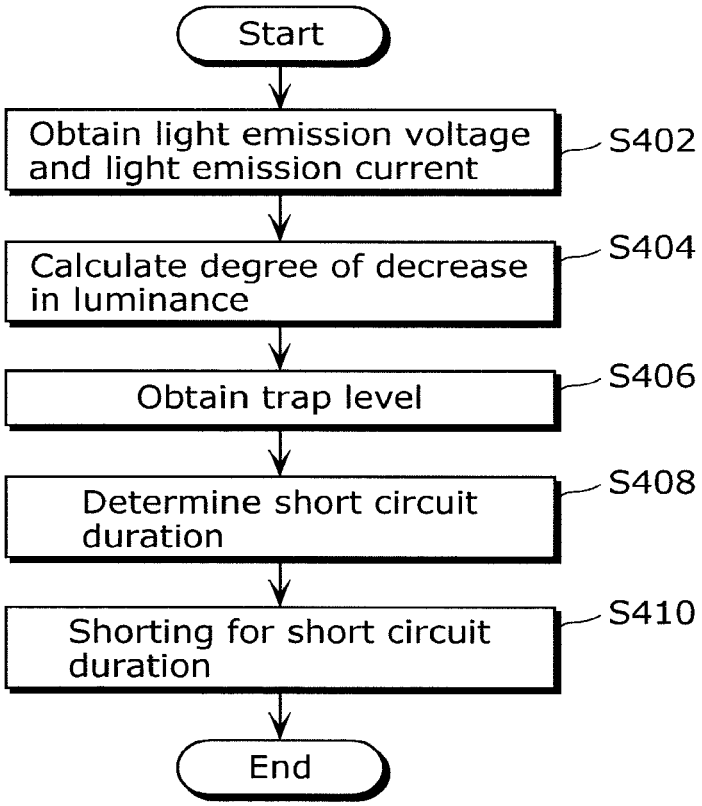
FIG. 20 is a flowchart showing one example of a method of driving the display apparatus, for restoring decreased luminance of a light emitting element according to Variation 3 of Embodiment 1.

FIG. 20 is a flowchart showing one example of the method of driving the display apparatus 1, for restoring decreased luminance of the light emitting element 110 according to Variation 3 of Embodiment 1.

Firstly, the voltage and current obtaining unit 65 obtains the light emission voltage and light emission current for the light emitting element 110 (S402), and the control unit 80 calculates a degree of decrease in luminance of the light emitting element 110 (S404) and obtains the trap level (S406). Details are omitted as they are explained with reference to FIG. 18.

Next, the control unit 80 determines, based on the obtained trap level, the short circuit duration for which the circuit between the anode and cathode of the light emitting element 110 is shorted (S408).

It has been found that as the trap level is deeper, the short circuit duration becomes longer. In sum, as the degree of decrease in luminance in the light emitting element 110 is higher, the short circuit duration becomes longer.

Thus, the control unit 80 determines the short circuit duration by calculating the short circuit duration associated with the trap level.

The control unit 80 controls the shorting unit 45 so that the circuit between the anode and cathode of the light emitting element 110 is shorted for the determined short circuit duration, and the shorting unit 45 provides an electrical short (S410).

Such an electrical short between the anode and cathode of the light emitting element 110 for the short circuit duration associated with the degree of decrease in luminance of the light emitting element 110, optimizes restoration of decreased luminance of the light emitting element 110, which can provide the light emitting element 110 with a longer life.

In sum, the trap level is used in such a way that the shorting transistor 170 provides an electrical short between the anode and cathode of the light emitting element 110 for the short circuit duration associated with the trap level, to remove the charges from the trap level. The short circuit duration for which the shorting transistor 170 provides the electrical short, therefore varies in association with the trap level. The trap level can be determined properly by focusing on the degree of decrease in luminance of the light emitting element 110. The short circuit duration for which the shorting transistor 170 provides the electrical short, therefore varies in association with the degree of decrease in luminance of the light emitting element 110.

The degree of decrease in luminance of the light emitting element 110 is associated with use duration of the light emitting element 110. This means that as the use duration of the light emitting element 110 is longer, the degree of decrease in luminance of the light emitting element becomes higher. Accordingly, the degree of decrease in luminance of the light emitting element 110 varies in association with the use duration of the light emitting element 110, and the short circuit duration for which the shorting transistor 170 provides the electrical short varies in association with the degree of decrease in luminance of the light emitting element 110.

Consequently, it only takes a proper length of time to restore decreased luminance of the light emitting element 110, which can provide the light emitting element 110 with a longer life.

Embodiment 2

In the above Embodiment 1, the control unit 80 obtains the trap level based on the use duration and the device temperature by referring to the trap level table 71, and obtains the level of the reverse bias voltage based on the obtained trap level by referring to the trap-bias table 72. In contrast, the control unit 80 in Embodiment 2 obtains the level of the reverse bias voltage without obtaining the trap level.

Figure 21:
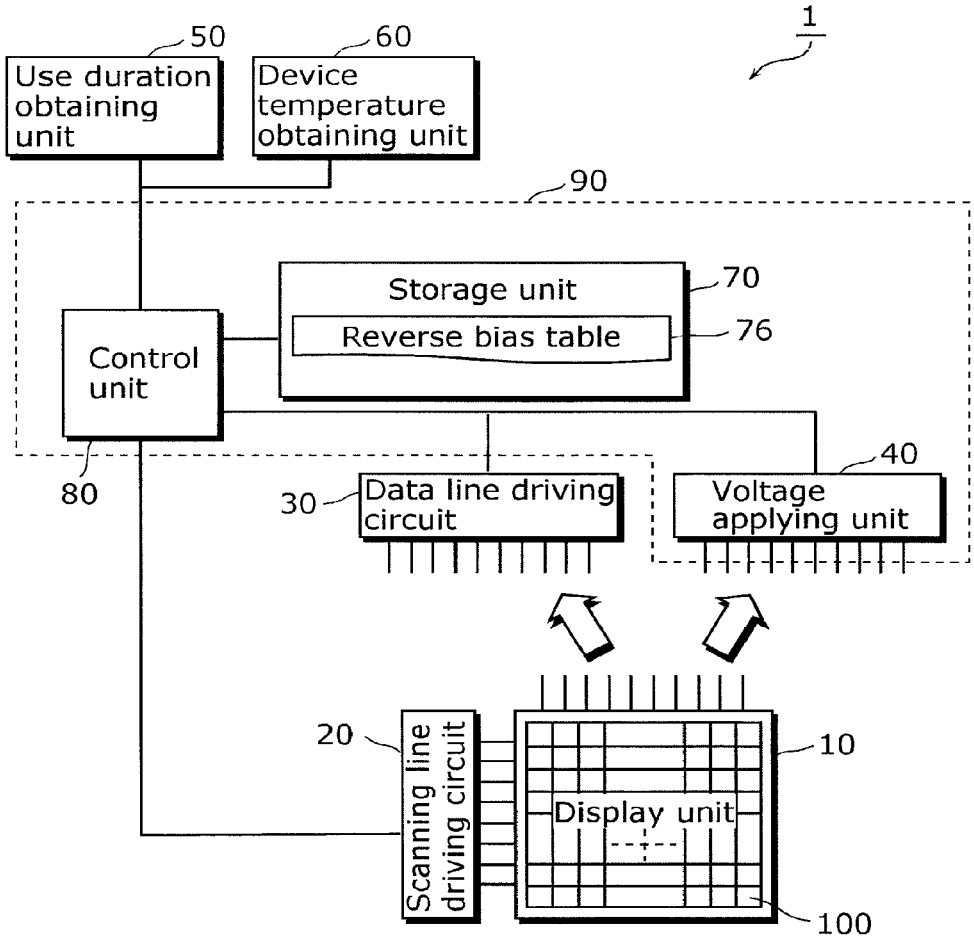
FIG. 21 is a block diagram showing configuration of a display apparatus according to Embodiment 2.

FIG. 21 is a block diagram showing configuration of a display apparatus 1 according to Embodiment 2.

As shown in FIG. 21, the display apparatus 1 includes a display unit 10, a scanning line driving circuit 20, a data line driving circuit 30, a use duration obtaining unit 50, a diode temperature obtaining unit 60, and a restoration processing unit 90. The restoration processing unit 90 includes a voltage applying unit 40, a storage unit 70, and a control unit 80. The circuit configuration of the pixel unit 100 and connections of the pixel unit 100 with the peripheral circuits are the same as those shown in FIG. 2. The components having functions already explained with reference to FIGS. 1 and 2 will not be explained below.

The storage unit 70 has a function of holding a level of a reverse bias voltage for each set of the use duration and device temperature of the light emitting element 110. To be specific, the storage unit 70 holds a reverse bias table 76 that associates the use duration, device temperature, and reverse bias voltage for the light emitting element 110 with one another.

Figures 22, 23:
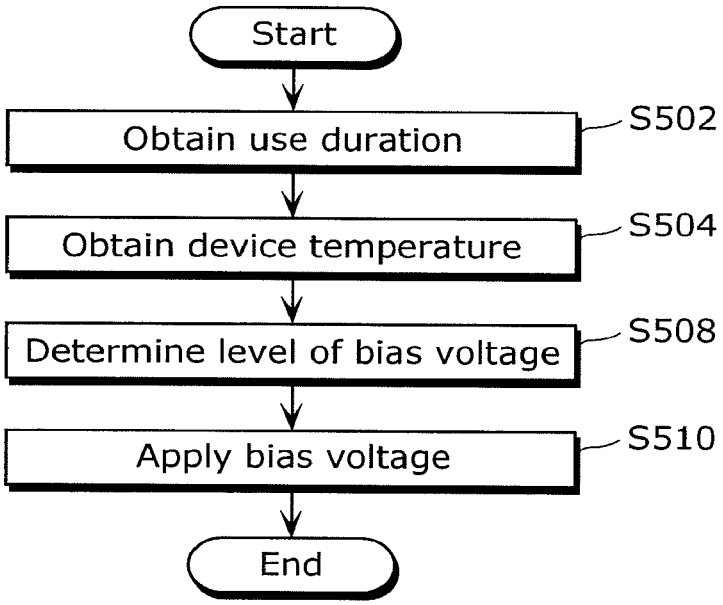
FIG. 22 is a view showing one example of a reverse bias table according to Embodiment 2.
FIG. 23 is a flowchart showing one example of a method of driving the display apparatus, for restoring decreased luminance of a light emitting element according to Embodiment 2.

FIG. 22 is a view showing one example of the reverse bias table 76 according to Embodiment 2.

As shown in FIG. 22, the reverse bias table 76 includes the use duration, the device temperature, and the reverse bias voltage. The use duration indicates a length of time for which the light emitting element 110 has been used, and the device temperature indicates a device temperature of the light emitting element 110. The reverse bias voltage indicates a level of the reverse bias voltage to be applied to the light emitting element 110.

This means that the reverse bias table 76 is a table which is combination of the trap level table 71 shown in FIG. 4 and the trap-bias table 72 shown in FIG. 6. Accordingly, the reverse bias table 76 can be created from the trap level table 71 and the trap-bias table 72 and will therefore not be explained in detail.

It is to be noted that the reverse bias table 76 may be created for each of the pixel units 100, or alternatively, the reverse bias table 76 common to all the pixel units 100 may be created.

Referring back to FIG. 21, the control unit 80 (*i*) reads out, by referring to the reverse bias table 76 held in the storage unit 70, the level of the reverse bias voltage associated with the use duration of the light emitting element 110, which corresponds to the use duration of the light emitting element 110 obtained from the use duration obtaining unit 50, and (ii) removes charges from the trap level by application, to the light emitting element 110, of the reverse bias voltage having the read-out level.

The control unit 80 changes the level of the reverse bias voltage which is to be applied to the light emitting element 110 so that as the use duration of the light emitting element 110 is loner, the level of the reverse bias voltage which is to be applied to the light emitting element 110 becomes higher.

Next, a method of driving the display apparatus 1 for restoring the decreased luminance of the light emitting element 110 will be explained.

FIG. 23 is a flowchart showing one example of a method of driving the display apparatus 1, for restoring decreased luminance of the light emitting element 110 according to Embodiment 1.

Firstly, the use duration obtaining unit 50 obtains the use duration of the light emitting element 110 (S502), and the device temperature obtaining unit 60 obtains the device temperature of the light emitting element 110 (S504). Details about how to obtain the use duration and the device temperature are omitted as they are explained with reference to FIG. 8 in Embodiment 1.

Subsequently, the control unit 80 determines the level of the bias voltage by referring to the reverse bias table 76 and obtaining the level of the reverse bias voltage associated with the obtained use duration and device temperature (S508).

The control unit 80 then controls the voltage applying unit 40 so that the voltage applying unit 40 applies the bias voltage having the determined level to the anode of the light emitting element 110, and the voltage applying unit 40 applies the bias voltage (S510). This means that the voltage applying unit 40 applies to the light emitting element 110 the reverse bias voltage obtained from the control unit 80. Details about how to apply the reverse bias voltage are omitted as they are explained with reference to FIG. 8 in Embodiment 1.

By doing so, the control unit 80 obtains the level of the reverse bias voltage without obtaining the trap level, and the reverse bias voltage is applied to the light emitting element 110. Such application of the bias voltage associated with the use duration and the device temperature optimizes restoration of decreased luminance of the light emitting element 110, which can provide the light emitting element 110 with a longer life.

In sum, the reverse bias voltage having a level which is associated with the trap level and varies in association with the use duration of the light emitting element 110, is applied to the light emitting element 110, to remove the charges from the trap level. The level of the reverse bias voltage to be applied to the light emitting element 110 thus varies in association with the use duration of the light emitting element 110 while reflecting the trap level. The trap level can be determined easily and properly by focusing on the use duration of the light emitting element 110. The level of the reverse bias voltage to be applied to the light emitting element 110 therefore varies in association with the use duration of the light emitting element 110.

Accordingly, the reverse bias voltage to be applied to the light emitting element 110 will not be extremely high so that the light emitting element 110 can be reliably protected from breakage, and decreased luminance of the light emitting element 110 can be restored properly, which can provide the light emitting element 110 with a longer life.

Variation 1 of Embodiment 2

The following shall describe Variation 1 of Embodiment 2. In the above Embodiment 2, the reverse bias voltage is applied to the light emitting element 110 to restore decreased luminance of the light emitting element 110. In contrast, the present Variation 1 provides an electrical short between the anode and cathode of the light emitting element 110 to restore decreased luminance of the light emitting element 110.

Figure 24:
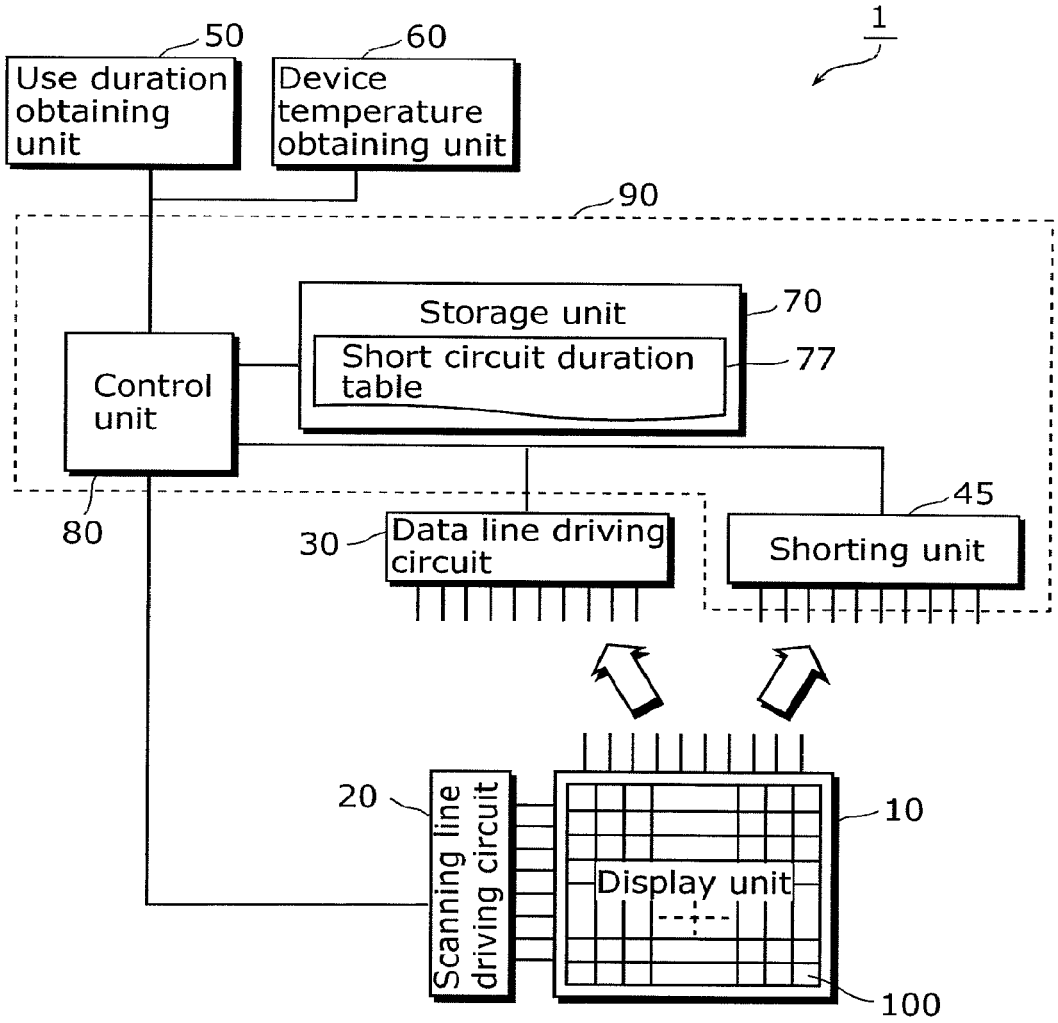
FIG. 24 is a block diagram showing configuration of a display apparatus according to Variation 1 of Embodiment 2.

FIG. 24 is a block diagram showing configuration of a display apparatus 1 according to Variation 1 of Embodiment 2.

As shown in FIG. 24, the display apparatus 1 includes a display unit 10, a scanning line driving circuit 20, a data line driving circuit 30, a use duration obtaining unit 50, a diode temperature obtaining unit 60, and a restoration processing unit 90. The restoration processing unit 90 includes a shorting unit 45, a storage unit 70, and a control unit 80. The circuit configuration of the pixel unit 100 and connections of the pixel unit 100 with the peripheral circuits are the same as those shown in FIG. 12. The components having functions already explained with reference to FIGS. 11 and 12 will not be explained below.

The storage unit 70 has a function of holding short circuit duration for each set of the use duration and device temperature of the light emitting element 110. To be specific, the storage unit 70 holds a short circuit duration table 77 that associates the use duration, device temperature, and short circuit duration of the light emitting element 110 with one another.

Figures 25, 26:
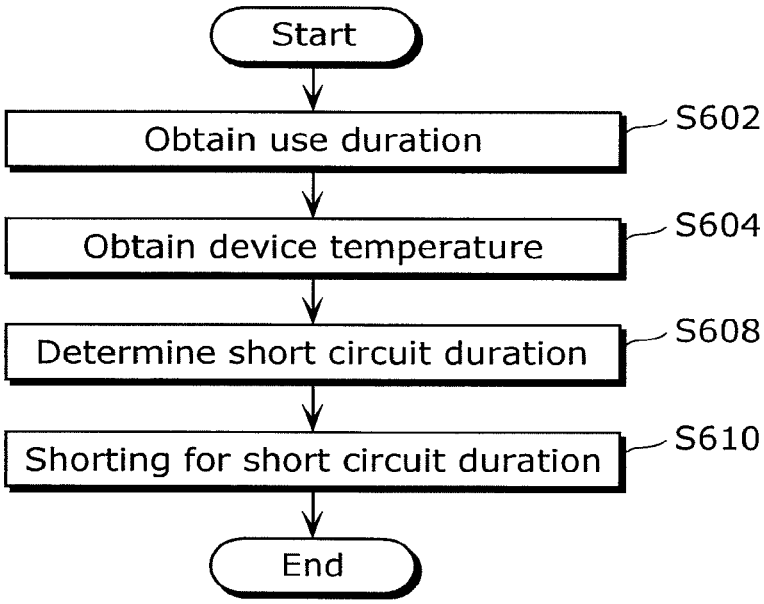
FIG. 25 is a view showing one example of a short circuit duration table according to Variation 1 of Embodiment 2.
FIG. 26 is a flowchart showing one example of a method of driving the display apparatus, for restoring decreased luminance of a light emitting element according to Variation 1 of Embodiment 2.

FIG. 25 is a view showing one example of the short circuit duration table 77 according to Variation 1 of Embodiment 2.

As shown in FIG. 25, the short circuit table 77 includes the use duration, the device temperature, and the short circuit duration. The use duration indicates a length of time for which the light emitting element 110 has been used, and the device temperature indicates a device temperature of the light emitting element 110. The short circuit duration indicates a length of time that the circuit between the anode and cathode of the light emitting element 110 is shorted.

This means that the short circuit duration table 77 is a table which is combination of the trap level table 71 shown in FIG. 4 and the trap-shorting table 75 shown in FIG. 13. Accordingly, the short circuit duration table 77 can be created from the trap level table 71 and the trap-shorting table 75 and will therefore not be explained in detail.

It is to be noted that the short circuit duration table 77 may be created for each of the pixel units 100, or alternatively, the short circuit duration table 77 common to all the pixel units 100 may be created.

Referring back to FIG. 24, the control unit 80 (*i*) reads out, by referring to the short circuit duration table 77 held in the storage unit 70, the short circuit duration associated with the use duration and device temperature of the light emitting element 110, which correspond to the use duration of the light emitting element 110 obtained from the use duration obtaining unit 50 and the device temperature of the light emitting element 110 obtained from the device temperature obtaining unit 60, and (ii) removes charges from the trap level by causing the shorting transistor 170 to provide an electrical short for the read-out short circuit duration.

The control unit 80 changes the short circuit duration for which the shorting transistor 170 provides the electrical short, so that as the use duration of the light emitting element 110 is longer, the short circuit duration for which the shorting transistor 170 provides the electrical short becomes longer.

Next, a method of driving the display apparatus 1 for restoring the decreased luminance of the light emitting element 110 will be explained.

FIG. 26 is a flowchart showing one example of the method of driving the display apparatus 1, for restoring decreased luminance of the light emitting element 110 according to Variation 1 of Embodiment 2.

Firstly, the use duration obtaining unit 50 obtains the use duration of the light emitting element 110 (S602), and the device temperature obtaining unit 60 obtains the device temperature of the light emitting element 110 (S604). Details about how to obtain the use duration and the device temperature are omitted as they are explained with reference to FIG. 15 in Embodiment 1.

Subsequently, the control unit 80 determines the short circuit duration by referring to the short circuit duration table 77 and obtaining the short circuit duration associated with the obtained use duration and device temperature (S608).

The control unit 80 controls the shorting unit 45 so that the circuit between the anode and cathode of the light emitting element 110 is shorted for the determined short circuit duration, and the shorting unit 45 provides an electrical short (S610). Details about this shorting process are omitted as they are explained with reference to FIG. 15 in Embodiment 1.

The control unit 80 thus obtains the short circuit duration without obtaining the trap level, and for the short circuit duration, the circuit between the anode and cathode of the light emitting element 110 is shorted. Such an electrical short between the anode and cathode of the light emitting element 110 for the short circuit duration associated with the use duration and device temperature, optimizes restoration of decreased luminance of the light emitting element 110, which can provide the light emitting element 110 with a longer life.

Variation 2 of Embodiment 2

The following shall describe Variation 2 of Embodiment 2. In the above Embodiment 2 and Variation 1 thereof, as the use duration of the light emitting element 110 is longer, a higher reverse bias voltage is applied, or the short circuit duration is made longer, to restore decreased luminance of the light emitting element 110. In contrast, the present Variation 2 increases the reverse bias voltage which is to be applied to the light emitting element 110 as a degree of decrease in luminance of the light emitting element 110 is higher, thereby restoring decreased luminance of the light emitting element 110.

Figure 27:
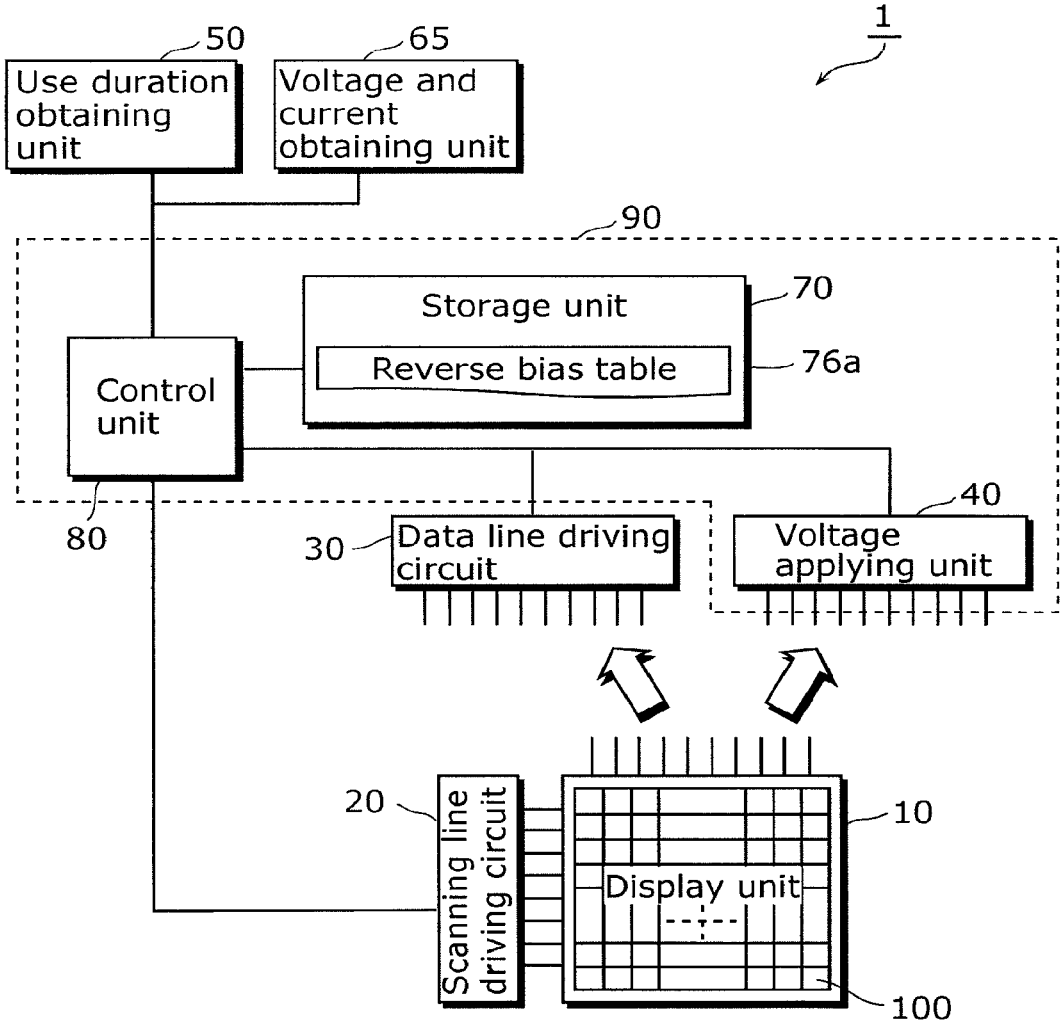
FIG. 27 is a block diagram showing configuration of a display apparatus according to Variation 2 of Embodiment 2.

FIG. 27 is a block diagram showing configuration of a display apparatus 1 according to Variation 2 of Embodiment 2.

As shown in FIG. 27, the display apparatus 1 includes a display unit 10, a scanning line driving circuit 20, a data line driving circuit 30, a use duration obtaining unit 50, a voltage and current obtaining unit 65, and a restoration processing unit 90. The restoration processing unit 90 includes a voltage applying unit 40, a storage unit 70, and a control unit 80. The circuit configuration of the pixel unit 100 and connections of the pixel unit 100 with the peripheral circuits are the same as those shown in FIG. 2. The components having functions already explained with reference to FIGS. 2 and 16 will not be explained below.

The storage unit 70 has a function of holding a reverse bias voltage for each degree of decrease in luminance associated with the use duration. To be more specific, what the storage unit 70 holds is a reverse bias table 76*a* that associates the degree of decrease in luminance of the light emitting element 110 with the reverse bias voltage.

Figures 28, 29:
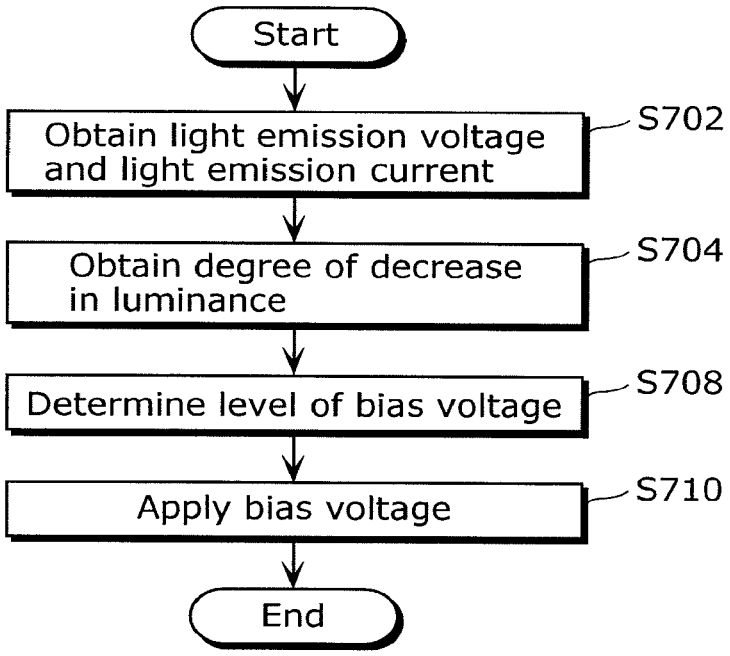
FIG. 28 is a view showing one example of a reverse bias table according to Variation 2 of Embodiment 2.
FIG. 29 is a flowchart showing one example of a method of driving the display apparatus, for restoring decreased luminance of a light emitting element according to Variation 2 of Embodiment 2.

FIG. 28 is a view showing one example of the reverse bias table 76*a* according to Variation 2 of Embodiment 2.

As shown in FIG. 28, the reverse bias table 76*a* includes the degree of decrease in luminance and the reverse bias voltage. The degree of decrease in luminance indicates a degree of decrease in luminance of the light emitting element 110, which is associated with use duration. The reverse bias voltage indicates a level of the reverse bias voltage to be applied to the light emitting element 110.

This means that the reverse bias table 76*a* is a table which is combination of the trap level table 71 shown in FIG. 17 and the trap-bias table 72 shown in FIG. 6. Accordingly, the reverse bias table 76*a* can be created from the trap level table 71*a* and the trap-bias table 72 and will therefore not be explained in detail.

It is to be noted that the reverse bias table 76*a* may be created for each of the pixel units 100, or alternatively, the reverse bias table 76*a* common to all the pixel units 100 may be created.

Referring back to FIG. 27, the control unit 80 (*i*) calculates a degree of decrease in luminance of the light emitting element 110 based on the light emission voltage and light emission current for the light emitting element 110, (ii) reads out, by referring to the reverse bias table 76*a* held in the storage unit 70, the level of the reverse bias voltage associated with the calculated degree of decrease in luminance, and (iii) removes charges from the trap level by application, to the light emitting element 110, of the reverse bias voltage having the read-out level.

The control unit 80 changes the level of the reverse bias voltage which is to be applied to the light emitting element 110 so that as the degree of decrease in luminance of the light emitting element 110 is higher, the level of the reverse bias voltage which is to be applied to the light emitting element 110 becomes higher.

Next, a method of driving the display apparatus 1 for restoring the decreased luminance of the light emitting element 110 will be explained.

FIG. 29 is a flowchart showing one example of the method of driving the display apparatus 1, for restoring decreased luminance of the light emitting element 110 according to Variation 2 of Embodiment 2.

Firstly, the voltage and current obtaining unit 65 obtains the light emission voltage and light emission current for the light emitting element 110 (S702), and the control unit 80 calculates a degree of decrease in luminance of the light emitting element 110 (S704). Details about how to obtain the light emission voltage and light emission current and calculate the degree of decrease in luminance are omitted as they are explained with reference to FIG. 18 in Embodiment 1.

The control unit 80 then determines the level of the bias voltage by referring to the reverse bias table 76*a* and obtaining the level of the reverse bias voltage associated with the calculated degree of decrease in luminance of the light emitting element 110 (S708).

The control unit 80 then controls the voltage applying unit 40 so that the voltage applying unit 40 applies the bias voltage having the determined level to the anode of the light emitting element 110, and the voltage applying unit 40 applies the bias voltage (S710). This means that the voltage applying unit 40 applies to the light emitting element 110 the reverse bias voltage obtained from the control unit 80. Details about how to apply the reverse bias voltage are omitted as they are explained with reference to FIG. 18 in Embodiment 1.

By doing so, the control unit 80 obtains the level of the reverse bias voltage without obtaining the trap level, and the reverse bias voltage is applied to the light emitting element 110. Such application of the bias voltage associated with the degree of decrease in luminance of the light emitting element 110 optimizes restoration of decreased luminance of the light emitting element 110, which can provide the light emitting element 110 with a longer life.

In sum, the reverse bias voltage having a level which is associated with the trap level and varies in association with the degree of decrease in luminance of the light emitting element 110, is applied to the light emitting element 110, to remove the charges from the trap level. The level of the reverse bias voltage to be applied to the light emitting element 110 thus varies in association with the degree of decrease in luminance of the light emitting element 110 while reflecting the trap level. The trap level can be determined properly by focusing on the degree of decrease in luminance of the light emitting element 110. The level of the reverse bias voltage to be applied to the light emitting element 110 therefore varies in association with the degree of decrease in luminance of the light emitting element 110.

Accordingly, the reverse bias voltage to be applied to the light emitting element 110 will not be extremely high so that the light emitting element 110 can be reliably protected from breakage, and decreased luminance of the light emitting element 110 can be restored properly, which can provide the light emitting element 110 with a longer life.

Variation 3 of Embodiment 2

The following shall describe Variation 3 of Embodiment 2. In the above Embodiment 2 and Variation 1 thereof, as the use duration of the light emitting element 110 is longer, a higher reverse bias voltage is applied, or the short circuit duration is made longer, to restore decreased luminance of the light emitting element 110. In the above Variation 2 of Embodiment 2, as a degree of decrease in luminance of the light emitting element 110 is higher, a higher reverse bias voltage is applied to the light emitting element 110 to restore decreased luminance of the light emitting element 110. In contrast, the present Variation 3 makes the short circuit duration of the light emitting element 110 longer as the degree of decrease in luminance of the light emitting element 110 is higher, thereby restoring decreased luminance of the light emitting element 110.

Figure 30:
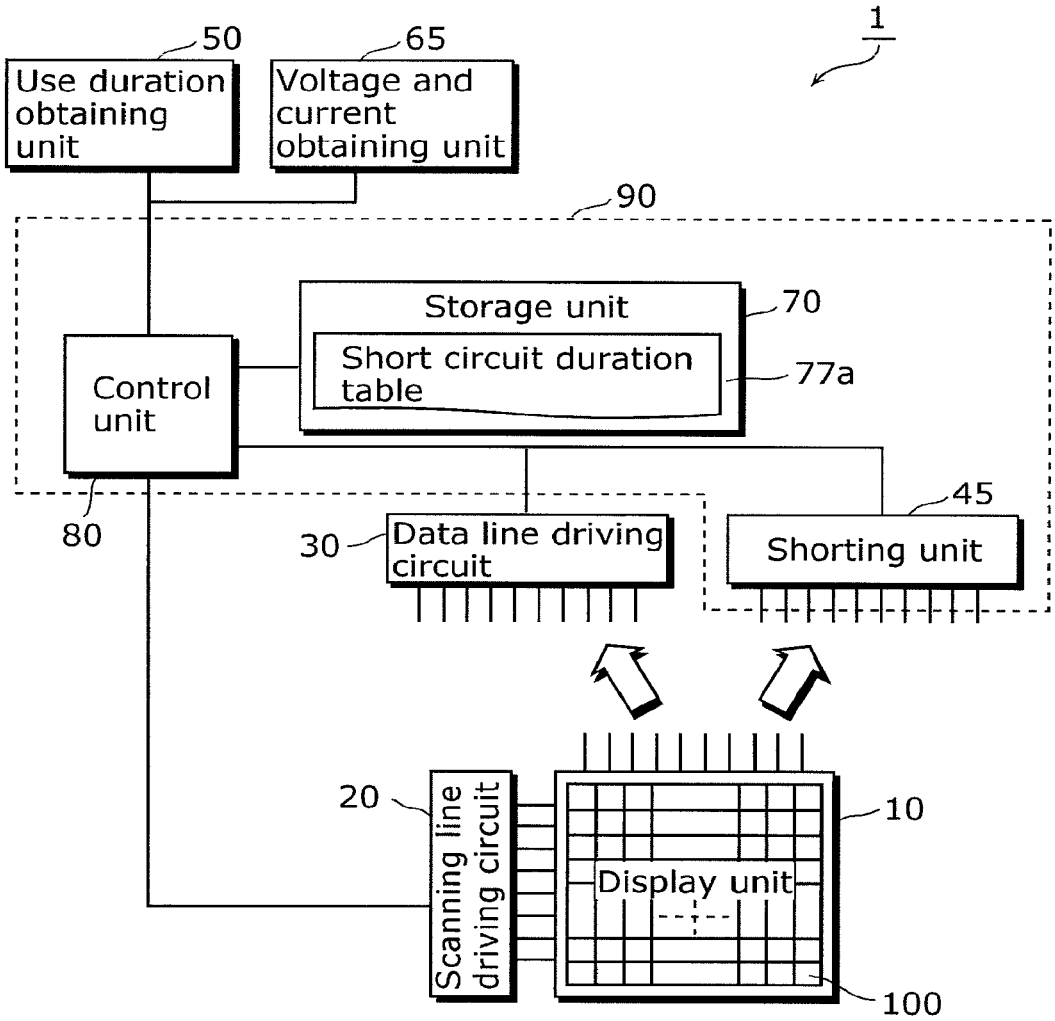
FIG. 30 is a block diagram showing configuration of a display apparatus according to Variation 3 of Embodiment 2.

FIG. 30 is a block diagram showing configuration of a display apparatus 1 according to Variation 3 of Embodiment 2.

As shown in FIG. 30, the display apparatus 1 includes a display unit 10, a scanning line driving circuit 20, a data line driving circuit 30, a use duration obtaining unit 50, a voltage and current obtaining unit 65, and a restoration processing unit 90. The restoration processing unit 90 includes a shorting unit 45, a storage unit 70, and a control unit 80. The circuit configuration of the pixel unit 100 and connections of the pixel unit 100 with the peripheral circuits are the same as those shown in FIG. 12. The components having functions already explained with reference to FIGS. 12 and 19 will not be explained below.

The storage unit 70 has a function of holding short circuit duration for each degree of decrease in luminance of the light emitting element 110 associated with the use duration. To be more specific, what the storage unit 70 holds is a short circuit duration table 77*a* that associates the degree of decrease in luminance of the light emitting element 110 with the short circuit duration.

Figures 31, 32:
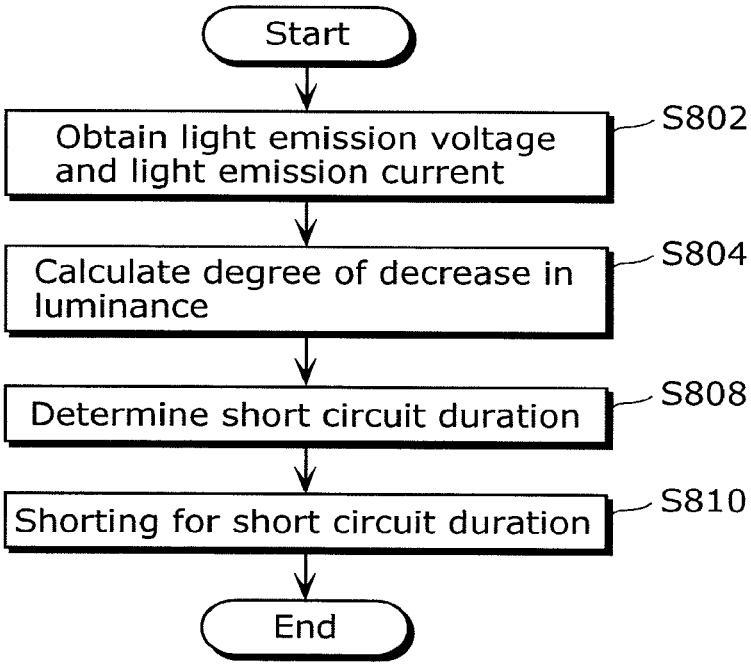
FIG. 31 is a view showing one example of a short circuit duration table according to Variation 3 of Embodiment 2.
FIG. 32 is a flowchart showing one example of a method of driving the display apparatus, for restoring decreased luminance of a light emitting element according to Variation 3 of Embodiment 2.

FIG. 31 is a view showing one example of the short circuit duration table 77*a* according to Variation 3 of Embodiment 2.

As shown in FIG. 31, the short circuit duration table 77*a* includes the degree of decrease in luminance and the short circuit duration. The degree of decrease in luminance indicates a degree of decrease in luminance of the light emitting element 110, which is associated with use duration. The short circuit duration indicates a length of time that the circuit between the anode and cathode of the light emitting element 110 is shorted.

This means that the short circuit duration table 77*a* is a table which is combination of the trap level table 71*a* shown in FIG. 17 and the trap-shorting table 75 shown in FIG. 13. Accordingly, the short circuit duration table 77*a* can be created from the trap level table 71*a* and the trap-shorting table 75 and will therefore not be explained in detail.

It is to be noted that the short circuit duration table 77*a* may be created for each of the pixel units 100, or alternatively, the short circuit duration table 77*a* common to all the pixel units 100 may be created.

Referring back to FIG. 30, the control unit 80 (*i*) calculates a degree of decrease in luminance of the light emitting element 110 based on the light emission voltage and light emission current for the light emitting element 110, (ii) reads out, by referring to the short circuit table 77*a* held in the storage unit 70, the short circuit duration associated with the calculated degree of decrease in luminance, and (iii) removes charges from the trap level by causing the shorting transistor 170 to provide an electrical short for the read-out short circuit duration.

The control unit 80 changes the short circuit duration for which the shorting transistor 170 provides the electrical short, so that as the degree of decrease in luminance of the light emitting element 110 is higher, the short circuit duration for which the shorting transistor 170 provides the electrical short becomes longer.

Next, a method of driving the display apparatus 1 for restoring the decreased luminance of the light emitting element 110 will be explained.

FIG. 32 is a flowchart showing one example of the method of driving the display apparatus 1, for restoring decreased luminance of the light emitting element 110 according to Variation 3 of Embodiment 2.

Firstly, the voltage and current obtaining unit 65 obtains the light emission voltage and light emission current for the light emitting element 110 (S802), and the control unit 80 calculates a degree of decrease in luminance of the light emitting element 110 (S804). Details about how to obtain the light emission voltage and light emission current and calculate the degree of decrease in luminance are omitted as they are explained with reference to FIG. 20 in Embodiment 1.

The control unit 80 then determines the short circuit duration by referring to the short circuit duration table 77*a* and obtaining the short circuit duration associated with the calculated degree of decrease in luminance of the light emitting element 110 (S808).

The control unit 80 controls the shorting unit 45 so that the circuit between the anode and cathode of the light emitting element 110 is shorted for the determined short circuit duration, and the shorting unit 45 provides an electrical short (S810). Details about this shorting process are omitted as they are explained with reference to FIG. 20 in Embodiment 1.

The control unit 80 thus obtains the short circuit duration without obtaining the trap level, and for the short circuit duration, the circuit between the anode and cathode of the light emitting element 110 is shorted. Such an electrical short between the anode and cathode of the light emitting element 110 for the short circuit duration associated with the degree of decrease in luminance of the light emitting element 110, optimizes restoration of decreased luminance of the light emitting element 110, which can provide the light emitting element 110 with a longer life.

Figure 33:
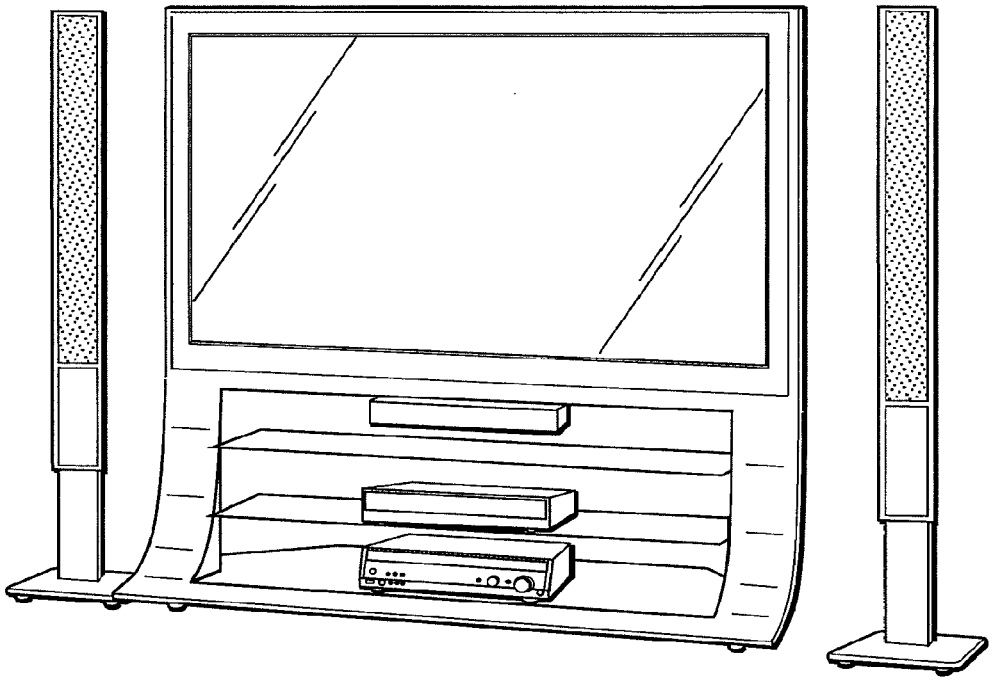
FIG. 33 is an appearance diagram of a thin flat television incorporating the display apparatus according to the present invention.

The display apparatus 1 according to the present invention is, for example, embedded in a thin flat television as shown in FIG. 33. The display apparatus 1 according to the present invention provides a thin flat television having a display which is capable of optimally restoring decreased luminance of the light emitting element 110.

The present invention is not limited to the above embodiments and variations thereof which are used to describe the display apparatus 1 according to the present invention.

That is, the above disclosed embodiments should be construed in all aspect as illustrative and not restrictive. The following claims rather than the foregoing description indicate the scope of the present invention, and all changes coming within the meaning and equivalency range of the claims are intended to be embraced therein. In addition, the components in the above embodiments may be combined in any way without departing from the intent of the invention.

For example, in Embodiments 1, 2 and Variations thereof, the use duration obtaining unit 50 is configured to obtain as use duration an accumulated value of lengths of time that the light emitting element 110 emits light. However, the use duration obtaining unit 50 may be configured to obtain as use duration an accumulated value of lengths of time that the display apparatus 1 is driven, or an accumulated value of results of multiplying the level of the light emission voltage for the light emitting element 110 by the length of time that the light emitting element 110 emits light.

Further, in Embodiments 1, 2 and Variations 1 thereof, the device temperature obtaining unit 60 is configured to obtain the device temperature of the light emitting element 110 from the properties of the driving transistor 120. However, the device temperature obtaining unit 60 may be configured to obtain the device temperature of the light emitting element 110 by using a temperature sensor by which the device temperature of the light emitting element 110 is measured.

Further, in Embodiments 1, 2 and Variations 1 thereof, the device temperature obtaining unit 60 is configured to obtain the device temperature of the light emitting element 110 for each of the pixel units 100. However, the device temperature obtaining unit 60 may be configured to obtain as a representative a device temperature of one light emitting element 110 included in the light emitting elements 110 of the pixel units 100, and apply the obtained device temperature as device temperatures of the other light emitting elements 110.

Further, in Embodiments 1, 2 and Variations 1 thereof, the control unit 80 is configured to determine the level of the bias voltage and the short circuit duration from the device temperature obtained from the device temperature obtaining unit 60. However, the control unit 80 may be configured to determine the level of the bias voltage and the short circuit duration without providing the device temperature obtaining unit 60 to obtain the device temperature by setting the device temperature in advance to a typical value.

Further, in Embodiments 1, 2 and Variations 2 thereof, the control unit 80 is configured to control the level of the bias voltage to be higher as the use duration of the degree of decrease in luminance is higher. However, the control unit 80 may be configured to control the level of the bias voltage to be higher and the length of time that the bias voltage is applied is longer as the use duration is longer or as the degree of decrease in luminance is higher.

Further, in Variations 1 and 3 of Embodiments 1 and 2, the control unit 80 is configured to control the short circuit duration to be longer as the use duration is longer or as the degree of decrease in luminance is higher. However, the control unit 80 may be configured to control the length of time that the reverse bias voltage is applied, to be longer as the use duration is longer or as the degree of decrease in luminance is higher, even in the case where the circuit between the anode and cathode of the light emitting element 110 is not shorted and where the reverse bias voltage being applied to the light emitting element 110 is constant.

Further, in Embodiments 1, 2 and Variations 2 thereof, the control unit 80 is configured to restore the decreased luminance of the light emitting element 110 by application of the bias voltage to the anode of the light emitting element 110. However, the control unit 80 may be configured to restore the decreased luminance of the light emitting element 110 by application of the bias voltage to only the cathode or both the anode and the cathode, of the light emitting element 110, so that the cathode will be at a higher potential than the anode. In addition, the control unit 80 may also be configured to control the application of the bias voltage so that the anode of the light emitting element 110 will be at the same or a little higher potential than the cathode of the light emitting element 110, if the decreased luminance of the light emitting element 110 can be restored by doing so.

Further, in Embodiment 1 and Variations thereof, the control unit 80 is configured to obtain the trap level from the trap level table 71 or 71*a* stored in advance in the storage unit 70. However, the control unit 80 may be configured to obtain the trap level from the trap level table 71 or 71*a* which is updated based on the trap level calculated from the measured light emission voltage and light emission current for the light emitting element 110.

Further, in Embodiment 2 and Variation 2 thereof, the control unit 80 is configured to obtain the level of the reverse bias voltage from the reverse bias table 76 or 76*a* stored in advance in the storage unit 70. However, the control unit 80 may be configured to obtain the level of the reverse bias voltage from the reverse bias table 76 or 76*a* which is updated based on the trap level calculated from the measured light emission voltage and light emission current for the light emitting element 110.

Further, in Variations 1 and 3 of Embodiment 2, the control unit 80 is configured to obtain the short circuit duration from the short circuit duration table 77 or 77*a* stored in advance in the storage unit 70. However, the control unit 80 may be configured to obtain the short circuit duration from the short circuit duration table 77 or 77*a* which is updated based on the trap level calculated from the measured light emission voltage and light emission current for the light emitting element 110.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The present invention is useful especially for an organic EL flat panel display having a display apparatus therein, and is best suited for use as a display apparatus or the like which is capable of optimally restoring decreased luminance of a light emitting element such as an organic EL device and extending a life of the light emitting element.

What is claimed is:

1. A display apparatus, comprising:

a light emitting element;

a power line that supplies a current to the light emitting element;

a capacitor that stores a charge;

a driver that flows the current through the power line to the light emitting element, the current corresponding to the charge stored in the capacitor;

a memory that stores a plurality of trap levels in association with a plurality of use durations of the light emitting element, each of the plurality of trap levels corresponding to an energy level generated in the light emitting element as the current is supplied to the light emitting element;

an obtainer configured to determine one of the plurality of use durations of the light emitting element;

a shorting transistor that provides an electrical short between an anode and a cathode of the light emitting element; and a controller configured to (i) read, from the memory, one of the plurality of trap levels associated with the one of the plurality of use durations of the light emitting element, and (ii) remove a charge generated in the light emitting element by controlling the shorting transistor to provide the electrical short for a short circuit duration associated with the one of the plurality of trap levels, wherein as the one of the plurality of use durations of the light emitting element increases, the short circuit duration increases.

2. The display apparatus according to claim 1, wherein each of the plurality of use durations of the light emitting element indicates a time period from a last end of the electrical short provided by the shorting transistor until a subsequent start of the electrical short provided by the shorting transistor.

3. The display apparatus according to claim 1, wherein the shorting transistor includes a source and a drain, one of the source and the drain being connected to the anode of the light emitting element, another of the source and the drain being connected to the cathode of the light emitting element.

4. The display apparatus according to claim 3, wherein the driver includes a source and a drain, one of the source and the drain being connected to the power line, another of the source and the drain being connected to the anode of the light emitting element.

5. The display apparatus according to claim 1, wherein as the one of the plurality of use durations of the light emitting element increases, the one of the plurality of trap levels increases, and as the one of the plurality of trap levels increases, the short circuit duration increases.

6. The display apparatus according to claim 5, wherein the short circuit duration increases linearly with the one of the plurality of trap levels.

7. The display apparatus according to claim 6, wherein the plurality of use durations each correspond to an accumulated value of lengths of time that the light emitting element emits light between a last end of the electrical short and a subsequent start of the electrical short.

8. The display apparatus according to claim 1, wherein the one of the plurality of trap levels associated with the one of the plurality of use durations of the light emitting element is further associated with a temperature of the light emitting element.

* * * * *